US012359377B1

(12) United States Patent
Bostany et al.

(10) Patent No.: US 12,359,377 B1
(45) Date of Patent: Jul. 15, 2025

(54) SWITCH POINT ROLLER ASSEMBLY

(71) Applicant: voestalpine Railway Systems Nortrak LLC, Sheridan, WY (US)

(72) Inventors: Thomas Bostany, Birmingham, AL (US); Bradley Gene Smith, Vestavia, AL (US); Eric Chandler Gray, Birmingham, AL (US); Adam Patrick Karnes-Aceves, Crown Point, IN (US); Brent Alan Duffner, Pinson, AL (US)

(73) Assignee: voestalpine Railway Systems Nortrak LLC, Sheridan, WY (US)

( * ) Notice: Subject to any disclaimer, the term of this patent is extended or adjusted under 35 U.S.C. 154(b) by 0 days.

(21) Appl. No.: 19/067,717

(22) Filed: Feb. 28, 2025

Related U.S. Application Data

(60) Provisional application No. 63/632,267, filed on Apr. 10, 2024.

(51) Int. Cl.
*E01B 7/02* (2006.01)
*E01B 7/08* (2006.01)

(52) U.S. Cl.
CPC ..... *E01B 7/02* (2013.01); *E01B 7/08* (2013.01); *E01B 2202/044* (2013.01); *E01B 2202/048* (2013.01)

(58) Field of Classification Search
CPC ..... E01B 2202/048; E01B 7/02; E01B 2202/046; E01B 2202/044; E01B 7/00; E01B 7/14
See application file for complete search history.

(56) References Cited

U.S. PATENT DOCUMENTS 1,965,803 A * 7/1934 Post ..... E01B 7/02 246/453
2,533,929 A * 12/1950 Gray ..... E01B 7/02 246/453

(Continued)

FOREIGN PATENT DOCUMENTS

AU 2017261622 A1 6/2018
CN 103806350 A 5/2014

(Continued)

OTHER PUBLICATIONS

Blue Roll (TM) Point Roller Brochure, URL: https://www.voestalpine.com/nortrak/static/sites/nortrak/.downloads/BlueRoll-Roller-Brochure-Dec-2020.pdf, retrieved on Jan. 28, 2024, archived at: https://web.archive.org/web/20211020125724/https://www.voestalpine.com/nortrak/static/sites/nortrak/.downloads/BlueRoll-Roller-Brochure-Dec-2020.pdf, dated Dec. 2020, entire document cited.

(Continued)

*Primary Examiner* — S. Joseph Morano
*Assistant Examiner* — Cheng Lin
(74) *Attorney, Agent, or Firm* — Tasty IP, Limited

(57) ABSTRACT

The disclosed solution generally relates to a switch point roller assembly. The switch point roller assembly is configured to be operatively connected to a switch point within a railway switch. The switch point roller assembly comprises a spring, a bolt assembly, a roller assembly, a housing assembly, and a base plate. The base plate may be secured such that the roller assembly is in substantial contact with a railway plate during movement of the switch point—such that the operation of the switch point is improved. As such, the switch point is more resilient to wear thus leading to decreased maintenance costs and increased safety for personnel, passengers, and property.

18 Claims, 14 Drawing Sheets

(56) References Cited

U.S. PATENT DOCUMENTS

| | | | | |
|---|---|---|---|---|
| 2,979,295 | A * | 4/1961 | Hewes | E01B 7/02 246/453 |
| 5,499,786 | A | 3/1996 | Durchschlag et al. | |
| 5,501,418 | A | 3/1996 | Humphrey et al. | |
| 5,509,626 | A | 4/1996 | Fodor | |
| 5,544,848 | A * | 8/1996 | Kuhn | E01B 7/14 246/468 |
| 5,628,480 | A | 5/1997 | Vrsecky et al. | |
| 6,189,840 | B1 | 2/2001 | Mantovan et al. | |
| 6,464,177 | B1 | 10/2002 | Heim | |
| 7,063,293 | B2 | 6/2006 | Leitner et al. | |
| 7,766,283 | B2 | 8/2010 | Lesemann et al. | |
| 8,430,364 | B1 | 4/2013 | Ashkenazi et al. | |
| 8,608,115 | B2 * | 12/2013 | Ruetzel | E01B 7/02 246/453 |
| 8,684,317 | B2 * | 4/2014 | Arnold | E01B 7/02 246/453 |
| 9,309,629 | B2 * | 4/2016 | Ashkenazi | E01B 7/02 |
| 11,236,470 | B2 * | 2/2022 | Reiser | E01B 7/02 |
| 11,447,917 | B2 * | 9/2022 | Reiser | E01B 7/02 |
| 2002/0079634 | A1 | 6/2002 | Lesemann | |
| 2007/0284484 | A1 | 12/2007 | Lesemann et al. | |
| 2008/0087773 | A1 | 4/2008 | Meyer | |
| 2009/0056585 | A1 | 3/2009 | Leitner et al. | |
| 2020/0385932 | A1 * | 12/2020 | Staribacher | B61L 5/02 |

FOREIGN PATENT DOCUMENTS

| | | | |
|---|---|---|---|
| CZ | 19201 | U1 | 12/2008 |
| DE | 3420505 | A1 | 12/1985 |
| DE | 102005032417 | A1 | 1/2007 |
| DE | 102014212074 | A1 | 12/2015 |
| EP | 389851 | A2 | 10/1990 |
| EP | 0692570 | A1 | 1/1996 |
| EP | 0964100 | A2 | 12/1999 |
| EP | 1055778 | A2 | 11/2000 |
| EP | 1194649 | A1 | 4/2002 |
| EP | 2653611 | A1 | 10/2013 |
| EP | 2708646 | A2 | 3/2014 |
| EP | 2735649 | A2 | 5/2014 |
| EP | 2995718 | | 3/2016 |
| EP | 2995718 | A1 | 3/2016 |
| GB | 325977 | A | 3/1930 |
| GB | 2417508 | A | 3/2006 |
| GB | 2442850 | A | 4/2008 |
| JP | 2003034248 | A | 2/2003 |
| JP | 3824851 | B2 | 9/2006 |
| JP | 2007332696 | A | 12/2007 |
| KR | 20100115110 | A | 10/2010 |
| KR | 20120066440 | A | 6/2012 |
| WO | 2005017258 | A1 | 2/2005 |
| WO | 2007140879 | A1 | 12/2007 |
| WO | 2008106708 | A1 | 9/2008 |
| WO | 2009129759 | A1 | 10/2009 |
| WO | 2019120339 | A1 | 6/2019 |

OTHER PUBLICATIONS

Ekoslide, "Ekoslide Demo Video (2023)," YouTube Video, URL: https://www.youtube.com/watch?v=p2S-PHmfNyg, archived URL: https://web.archive.org/web/20240128190858/https://www.youtube.com/watch?v=p2SPHmfNyg , dated Jul. 2023, retrieved on Jan. 28, 2024, entire document cited.

Ekoslide, "Products", URL: https://www.ekoslide.cz/en/product/, retrieved on Jan. 28, 2024, Archived at: https://web.archive.org/web/20230529220036/https://www.ekoslide.cz/en/product/, Archive dated: May 29, 2023, entire document cited.

Fox Trade GmbH Website, URL: http://www.foxtrade.net/ENGLISH/innovationenE.html, original date unknown, Archive URL: https://web.archive.org/web/20080724185456/http:/www.foxtrade.net/ENGLISH/innovationenE.html, archive dated: Jul. 24, 2008, original website down, entire document cited.

IAT International Ekoslide Technical Brochure, URL: https://iatint.com/wp-content/uploads/2018/07/IAT_Ekoslide_Technical_Brochure.pdf, retrieved on: Jan. 28, 2024, initial publication unknown, Archived at: https://web.archive.org/web/20240128185609/https://iatint.com/wp-content/uploads/2018/07/IAT_Ekoslide_Technical_Brochure.pdf, Archived on Jan. 28, 2024, entire document cited.

IAT International Products Website, URL: https://iatint.com/switch-components/, retrieved on: Jan. 28, 2024, initial publication date unknown, Archived at: https://web.archive.org/web/20230202110000/https://iatint.com/switch-components/, archived on Feb. 2, 2023, entire document cited.

Rama, et al., "A Reliability Analysis of Railway Switches", Proceedings IMechE Part F: J Rail and Rapid Transit 227(4) 344-363, DOI: 10.1177/0954409713481725, dated Feb. 6, 2013, entire document cited.

Wieland Group, "Austroroll®—Doppelrolle montieren | Installation Double-Roller," Original URL: https://www.youtube.com/watch?v=mBKNNTJFChs, Original URL Dated: Oct. 23, 2023, Retrieved on: Mar. 1, 2024, Archived URL: https://web.archive.org/web/20240301201114/https://www.youtube.com/watch?v=mBKNNTJFChs, Archive Dated Mar. 1, 2024, entire document cited.

Wieland Group, "Austroroll®—Einzelrolle montieren | Installation Single-Roller," Original URL: https://www.youtube.com/watch?v=S1175VP1sMY, Originally Dated: Oct. 23, 2023, Retrieved on: Mar. 1, 2024, Archived URL: https://web.archive.org/web/20240301195551/https://www.youtube.com/watch?v=S1175VP1sMY, Archived on: Mar. 1, 2024, entire document cited.

Wieland Group, "Austroroll®—Function control" Original URL: https://www.youtube.com/watch?v=qz2DGMOj10Y, Originally Dated: Oct. 23, 2023, Retrieved on: Mar. 1, 2024, Archived URL: https://web.archive.org/web/20240302001900/https://www.youtube.com/watch?v=qz2DGMOj1OY, Archived on: Mar. 1, 2024, entire document cited.

Wieland Group, "Austroroll®—Functions Control Inspection," Original URL: https://www.youtube.com/watch?v=KvxwwbnYLrk, Originally Dated: Oct. 23, 2023, Retrieved on: Mar. 1, 2024, Archived URL: https://web.archive.org/web/20240302002645/https://www.youtube.com/watch?v=KvxwwbnYLrk, Archived on: Mar. 1, 2024, entire document cited.

Wieland Group, "Austroroll®—HSR—Functions Control," Original URL: https://www.youtube.com/watch?v=R7dyE1tkDQA, Originally Dated: Oct. 23, 2023, Retrieved on: Mar. 1, 2024, Archived URL: https://web.archive.org/web/20240302002128/https://www.youtube.com/watch?v=R7dyE1tkDQA, Archived on: Mar. 1, 2024, entire document cited.

Wieland Group, "Austroroll®—HSR—Installation Rollers," Original URL: https://www.youtube.com/watch?v=eescVInW4FM Originally Dated: Oct. 23, 2023 Retrieved on: Mar. 1, 2024 Archived URL: https://web.archive.org/web/20240302000748/https://www.youtube.com/watch?v=eescVInW4FM Archived on: Mar. 1, 2024, entire document cited.

Wieland Group, "Austroroll®—Wartungsfreie Rollvorrichtung für Eisenbahnweichen Roller device for railway points," Original URL: https://www.youtube.com/watch?v=vfHhjEMqcRM, Originally Dated Oct. 23, 2023, Retrieved on Feb. 29, 2024, Archived URL: https://web.archive.org/web/20240301171939/https://www.youtube.com/watch?v=vfHhjEMqcRM, Archived on: Mar. 1, 2024 , entire document cited.

Wieland Group, "Check plate solution," Original URL: https://www.youtube.com/watch?v=pbNJhJS6f94, Originally Dated: Jul. 9, 2020, Retrieved on: Mar. 1, 2024, Archived URL: https://web.archive.org/web/20240301193415/https://www.youtube.com/watch?v=pbNJhJS6f94, Archived on: Mar. 1, 2024, entire document cited.

Wieland Group, "Concrete direct attachment," Original URL: https://www.youtube.com/watch?v=pJw8bMpxWz4, Originally Dated: Jul. 9, 2020, Retrieved on: Mar. 1, 2024, Archived URL: https://web.archive.org/web/20240301193833/https://www.youtube.com/watch?v=pJw8bMpxWz4, Archived on: Mar. 1, 2024, entire document cited.

Wieland Group, "Fastening using threshold screws," Original URL: https://www.youtube.com/watch?v=QKajBQUV1Ts, Originally Dated: Jul. 9, 2020, Retrieved on: Mar. 1, 2024, Archive URL: https://web.

(56) References Cited

OTHER PUBLICATIONS archive.org/web/20240301191912/https://www.youtube.com/watch?v=QKajBQUV1Ts&themeRefresh=1, Archived on: Mar. 1, 2024, entire document cited.
Wieland Group, "Mark & clean threshold compartments," Original URL: https://www.youtube.com/watch?v=CDNXfoha_yQ, Originally Dated: Jul. 9, 2020, Retrieved on: Mar. 1, 2024, Archived URL: https://web.archive.org/web/20240301181848/https://www.youtube.com/watch?v=CDNXfoha_yQ, Archived on: Mar. 1, 2024, entire document cited.
Wieland Group, "Measure cutting length," Original URL: https://www.youtube.com/watch?v=CDNXfoha_yQ, Originally Dated: Jul. 9, 2020, Retrieved on: Mar. 1, 2024, Archived URL: https://web.archive.org/web/20240000000000*/https://www.youtube.com/watch?v=CDNXfoha_yQ, Archived on: Mar. 1, 2024, entire document cited.
Wieland Group, "Product Autroroller" Website, URL: https://www.wieland.com/en/products/product-categories/roller-device-for-railway-points/austroroll-assembly, retrieved on Mar. 7, 2024, archived URL: https://web.archive.org/web/20230923201708/https://www.wieland.com/en/products/product-categories/roller-device-for-railway-points/austroroll-assembly, archive dated Sep. 23, 2023, entire document cited.
Wieland Group, "Roller device for railway points" Website, original URL: https://www.wieland.com/en/products/roller-device-for-railway-points, original URL retrieved on Feb. 29, 2024, archived URL: https://web.archive.org/web/20231210142041/https://www.wieland.com/en/products/roller-device-for-railway-points, archive dated Dec. 10, 2023, entire document cited.
Wieland Group, "Wood direct attachment cutting aid," Original URL https://www.wieland.com/var/site/storage/images/4/9/5/0/880594-1-eng-GB/cfab5f884938-3c-Cutting-aid.jpg, Originally Dated: Unknown, Retrieved on: Mar. 1, 2024, Archived URL: https://web.archive.org/web/20240301195027/https://www.wieland.com/var/site/storage/images/4/9/5/0/880594-1-eng-GB/cfab5f884938-3c-Cutting-aid.jpg, Archived on: Mar. 1, 2024, entire document cited.
Wieland Group, "Wood direct attachment," Original URL: https://www.youtube.com/watch?v=of2vTYMM9p8, Originally Dated: Jul. 9, 2020, Retrieved on: Mar. 1, 2024, Archived URL: https://web.archive.org/web/20240301192841/https://www.youtube.com/watch?v=of2vTYMM9p8, Archived on: Mar. 1, 2024, entire document cited.
PCT ISA/210 International Search Report, PCT/US25/20775, dated Jun. 13, 2025, entire document cited.
PCT ISA/237 Written Opinion of International Searching Authority, PCT/US25/20775, dated Jun. 13, 2025, entire document cited.

* cited by examiner

SWITCH POINT ROLLER ASSEMBLY

CROSS REFERENCE AND PRIORITY TO RELATED APPLICATIONS

This application claims the benefit of priority to: U.S. Provisional No. 63/632,267 entitled "SWITCH POINT ROLLER ASSEMBLY," filed on Apr. 10, 2024.

All the aforementioned applications are hereby incorporated by reference in their entirety.

BACKGROUND

Railway switch points have various moving parts that are subject to maintenance operations in order to reduce mechanical failure. Typically, a switch point is moved with the assistance of a switch machine. As the force of the switch machine causes the switch point to move, the base of the switch point is in contact with the dorsal surfaces of railway plates. Even if the switch point is floating above such surfaces, the forces of passing railway stock cause the switch point to contact these surfaces. In the best case, the switch point is only forced in a vertical motion. However, often, the switch point is subject to both longitudinal forces while also being subject to vertical force (from rolling stock).

In the current state of the art, railway maintenance personnel administer lubricants at or near the switch point in order to reduce friction. However, such operations are labor-intensive and, thus, costly. Further, as with any human-based operation, the maintenance operations may be subject to human error. The human error can lead to the premature degradation of switch points which, at a minimum, increases long-term maintenance and/or replacement costs. In some cases, the switch point may completely seize due to lack of lubrication and become inoperative. In sum, the failure of switch points can lead to damage to property, potentially with the loss of human life.

Even when properly administered, lubricants only have a fixed duty cycle. The lubricants may degrade due to chemical composition, environmental factors, impurities, excessive friction, tamping, etc. Further, the amount of lubricant applied may be excessive or insufficient-both of which may, again, lead to loss of property and even life. Lubricant, even when properly administered, is difficult to verify for efficacy, i.e., human operators cannot quickly or even easily determine whether the lubricant is indeed performing as desired. In short, lubricants are not a wholly viable solution to reducing friction at or near switch points.

What is needed is a switch point roller assembly that provides reduced maintenance, improved safety, and many other benefits.

SUMMARY

A solution is disclosed which includes a switch point roller assembly and a kit. The kit may comprise a switch point and a switch point roller assembly, in one configuration. The switch point roller assembly may be configured for operation at or near a switch point of a railway switch.

The switch point roller assembly comprises a spring, a bolt assembly comprising a bolt and a nut, wherein the bolt comprises a hex head, wherein the hex head provides adjustment of the bolt. The switch point roller assembly further comprises a roller assembly comprising a roller, an axle retainer, and a first axle, wherein the axle retainer is operatively connected to the bolt assembly, wherein the first axle is disposed within the roller and the axle retainer, wherein the roller assembly is adjustable by the bolt assembly via the hex head.

The switch point roller assembly further comprises a housing assembly comprising a housing, wherein the housing assembly is operatively connected to the roller assembly via the bolt assembly, wherein the housing assembly is further operatively connected to the roller assembly, wherein the housing comprises (1) a first plurality of surfaces and (2) a second plurality of surfaces, wherein the nut is configured to substantially secure the bolt to a first surface within the first plurality of surfaces, wherein the spring is configured to be disposed between the base plate and a second surface within the second plurality of surfaces, wherein the housing further comprises a third plurality of surfaces, wherein the roller assembly is disposed partially within the housing with respect to the third plurality of surfaces.

The switch point roller assembly further comprises a base plate comprising a plurality of slots configured to attach the base plate to the switch point, wherein the base plate further comprises a spring support, wherein the spring is supported by the spring support and is in contact with the housing assembly.

The bolt comprises (1) a first bolt segment of a first diameter and is threaded, (2) a second bolt segment being a second diameter, wherein the second diameter is smaller than the first diameter, and (3) a third bolt segment, wherein the third bolt segment has a third diameter, wherein the third diameter is smaller than the second diameter.

The roller assembly further comprises (1) a first bushing in contact with the bolt assembly, (2) a retaining ring, wherein the retaining ring retains the bolt assembly at the axle retainer, and (3) a plurality of needle bearings, wherein the plurality of needle bearings provides for rolling of the roller about the first axle.

The axle retainer comprises (1) a first plurality of holes, supporting the first axle, and (2) a first hole accommodating the first bushing. The housing assembly comprises (1) a plurality of bushings, (2) a second axle, wherein the second axle is disposed within the plurality of bushings, (3) a plurality of retaining rings, wherein the plurality of retaining rings is configured to retain the second axle, and (4) a set screw, wherein the set screw is configured to be in contact with the second axle.

The housing further comprises (1) a second plurality of holes configured to accommodate the plurality of bushings and (2) a second hole configured to accommodate the bolt assembly. The base plate further comprises a protrusion having a third hole configured to accommodate the housing assembly, wherein the protrusion further comprises a threaded hole, wherein the threaded hole is oriented perpendicularly to the third hole and is configured to receive a set screw.

The spring support comprises an inner spring support and an outer spring support, wherein the spring is supported, at an inner diameter of the spring, via the inner spring support, wherein the spring is further supported, at an outer diameter of the spring, via the outer spring support. The spring may be polymer, polyester, urethane, hardened steel, or a combination thereof. The roller may be polymer, polyester, urethane, hardened steel, sealed glass having a nylon interior, or a combination thereof.

BRIEF DESCRIPTION OF DRAWINGS

The accompanying drawings, which are incorporated herein and constitute part of this specification, illustrate exemplary aspects of the claims, and together with the general description given above and the detailed description given below, serve to explain the features of the claims.

DETAILED DESCRIPTION

Figure 1A:
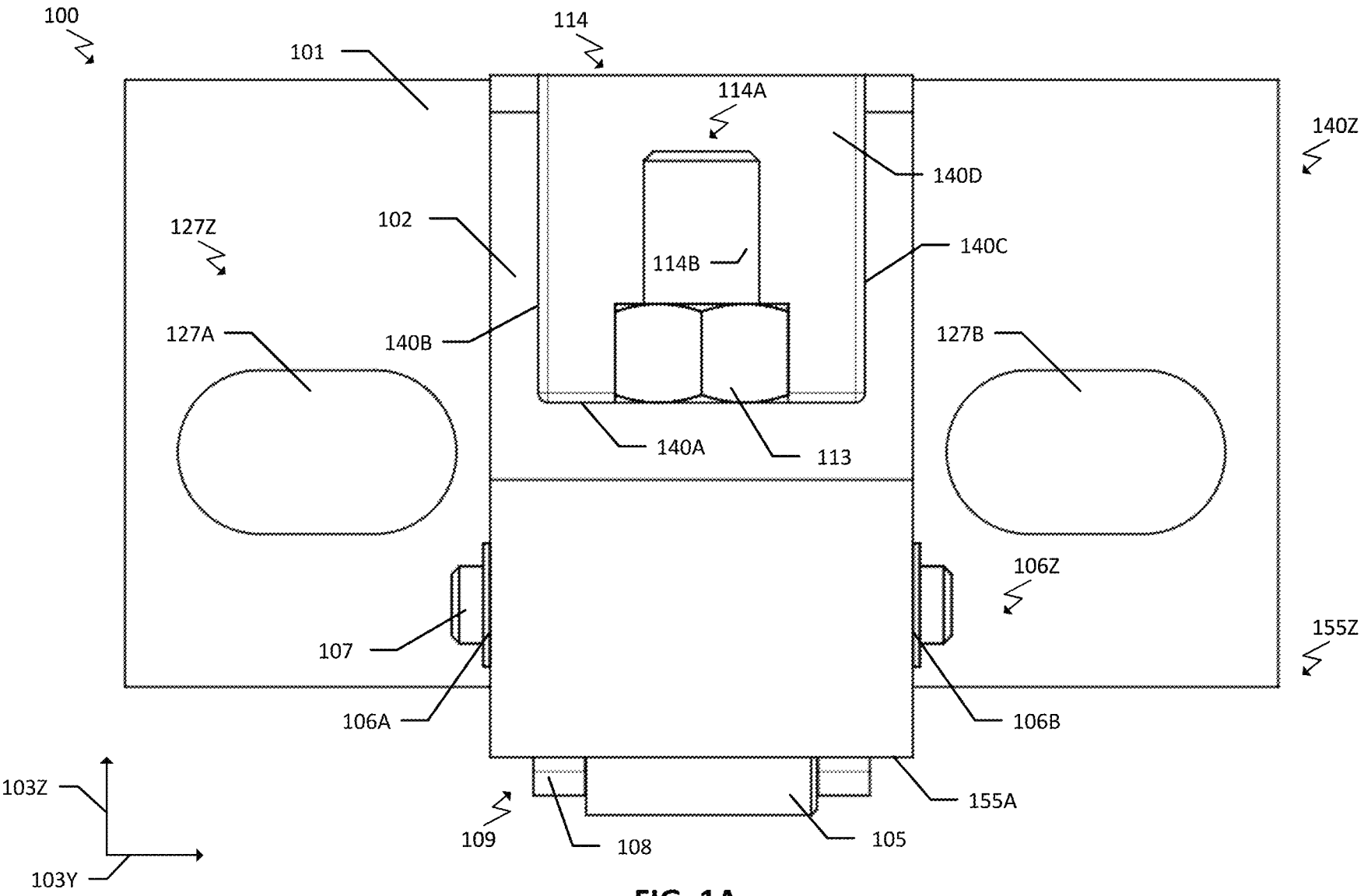
FIG. 1A is a planar view of a switch point roller assembly, as shown from a front perspective.

Various aspects will be described in detail with reference to the accompanying drawings. Wherever possible, the same reference numbers will be used throughout the drawings to refer to the same or like parts. References made to particular examples and implementations are for illustrative purposes, and are not intended to limit the scope of the claims.

Railway maintenance is critical to the safety of personnel, passengers, and property. Typically, lubricants are used to maintain moving parts within trackwork. However, some mechanical solutions are deployed as needed in order to reduce maintenance and improve safety. That stated, existing solutions have many problems that are addressed by the solution disclosed herein.

Some existing switch point roller solutions rely on installation below the switch point. For example, the switch point roller may be attached to the tie (i.e., sleeper) and/or railway plate with upward facing rollers that are in contact with the ventral surface of the moving switch point. These types of existing approaches may be thought of as "top up" solutions. One disadvantage of such solutions is the installation often requires the removal of existing hardware and components in order to access the installation point. For example, an entire railway tie may need removal and replacement in order to install the rolling assemblies. Alternatively, the switch point may require significant adjustment to access the area where such a rolling assembly would require installation.

In contrast, the disclosed solution is configured to be a "top-down" approach to the problem. The solution is configured to being attached to the switch point itself at the web (or D-bar) such that the switch point may be left in place during installation. Further, the railway tie and/or railway plate may be left in position during installation. As such, the disclosed solution may be easily installed and inspected by avoiding mechanical changes to additional track components.

Another problem with existing top-up solutions is the inability to easily inspect the installation and operation of the rolling assembly. Again, these types of solutions are installed below the moving switch point, sometimes within the railway tie or railway plate itself. When the device is in operation, personnel cannot see the actual operation of the device but only the switch point and surrounding components. As such, the device may be failing without personnel even noticing. This situation is often worse than application of lubricants because the device may entirely seize up and lead to failure of the entire switch.

In contrast, the disclosed solution is configured to be installed above the railway plate. As such, the disclosed solution is readily inspectable by personnel and/or more advanced techniques (e.g., automated inspection systems). Again, the disclosed solution is configured to being attached at or near the web of the switch point, thus being readily available for inspection.

Existing top-up solutions are difficult to maintain. Even assuming that inspection is easily performed, existing devices still require non-trivial maintenance and replacement operations. This situation is often as difficult if not more difficult than the already difficult installation process. One could foresee situations where the inspection only reveals a failing rolling device, e.g., by seizure of the switch point. However, the exact failing components may be unknown since the device cannot be visually inspected without removable and significant adjustment of the switch point.

In contrast, the disclosed solution is configured to being installed at or near the switch point. As such, the disclosed solution may be readily inspected and readily maintained. As with any railway component, the disclosed solution will be subject to severe wear-and-tear-including both environment and operational. Components may fail within the disclosed solution. For example, the roller may degrade due to environmental conditions. When this degradation is detected by personnel, the roller may be readily removed and replaced. Further, this operation is relatively fast when compared to existing solutions that are installed below the switch point.

Some existing solutions are attached via clamps at the base of the switch point. Clamps tend to fail because the clamping force is created by reciprocal clamps (or arms) that are both secured by bolts. One cause of failure is losing tension within the clamp (e.g., from failure of one or more of the bolt assemblies). Another cause of failure is simply the operation of rolling stock at the clamp which essentially vibrates the clamp from the rail. Personnel must then inspect and adjust the clamps to ensure the attached roller assemblies are still positioned and secured to support the transitions of the switch point.

In contrast, the disclosed solution is configured to being attached at or near the web of the switch point. The base plate of the disclosed solution may be bolted to the web at a D-bar assembly that is, in turn, connected to the switch point. As such, the disclosed solution relies on one or more bolts that are (1) easily accessible for installation and (2) readily torqued to maintain position.

Clamp-based solutions introduce interference issues at the railway. For example, the clamp often spans below the rail (or switch point) which requires the movement area to be free of objects. Otherwise, the clamps may interfere with gauge-side and/or field-side components. Even with the best clearance, conditions within the track change. For example, ballast may move out of position and start interfering with the clamps, thus leading to interference with the existing top-up solution. Another factor is tamping operations that may simply strike the clamps and disconnect the clamp-based solution from the track.

In contrast, the disclosed solution is configured to being secured at the web of the switch point. This configuration does not introduce the unnecessary risk of interference with gauge-side or track-side components. For example, the movement of ballast does not introduce a high-level of risk when compared to clamp-based solutions that are installed at the base of the rail and/or switch point.

Some top-down solutions rely on mechanical arms that protrude from the web of the rail. These arms hold the roller which then traverses the railway plate during movement of the switch point. However, these arm-based solutions require tensioning to adequately adjust the arm in order to create enough force to support the switch point during movement. Improper tension may cause the roller to be ineffective. Alternatively, improper tension may cause the entire device to break when loaded.

In contrast, the disclosed solution relies on a roller assembly that is substantially oriented toward the railway plate. This configuration is based, in part, on a housing assembly that supports the roller assembly via an axle. Minimal, if any, adjustment is necessary to enable the proper contact between the roller and the railway plate (or tie).

Existing solutions often fail to protect sensitive hardware from conditions at the track. For example, some solutions have adjustment/tensioning hardware that is unprotected from environmental elements. Other risks include maintenance equipment striking this type of hardware (e.g., during tamping operations). Any damage to adjustment hardware is undesirable. At a minimum, damage will cause the adjustments to deviate from nominal. At worst, the hardware component may be destroyed, thus leading to failure of the device. In short, existing solutions fail to consider the extreme conditions that trackside components face when operating in the field.

In contrast, the disclosed solution is configured such that sensitive hardware is provided additional protection from such hazards, damage, etc. For example, the switch point rolling assembly is configured such that a bolt assembly is partially protected, via a housing assembly, from hazards. This protection ensures the adjustments are maintained over the course of deployment but also that the bolt assembly has a longer duty cycle. The housing assembly is configured to provide protection while not impeding inspection, adjustment and service of components. Similar protection is provided to the spring and the roller assembly, as shall be disclosed below. In short, the disclosed solution provides enhanced protection of components without sacrificing serviceability.

Some existing solutions require careful adjustments to be made in order to provide consistent contact between the roller and the track component (e.g., the railway plate). However, any adjustment will be imperfect. For example, a railway plate itself may be uneven. As such, a static adjustment may not be sufficient to maintain contact between the roller and the railway plate.

In contrast, the disclosed solution is configured to maintain consistent contact between the roller assembly and the railway plate. The switch point roller assembly comprises a housing assembly that is substantially in contact with a spring that is, in turn, in contact with a base plate. The interaction of these components is such that the roller assembly maintains substantially consistent contact with the railway plate. Even with uneven surfaces at the railway plate, the roller assembly is configured to adjust dynamically.

Further benefits over the existing solutions shall be disclosed below through various embodiments/aspects of the disclosed solutions. One of skill in the art will appreciate that disclosed solution addresses many problems in the industry. As such, the maintenance of railway systems is improved which, in turn, leads to improved safety for personnel, passengers, and property.

FIG. 1A is a planar view of a switch point roller assembly 100, as shown from a front perspective. A plurality of axes is shown viz. a first axis 103X (projected toward the viewer), a second axis 103Y, and a third axis 103Z. The axis 103X is perpendicular to the direction of rolling stock traveling along the track. The axis 103Y is parallel to the direction of travel of rolling stock moving along the track. The axis 103Z is vertical, as formed by the normal vector of the axes 103X, 103Y.

The switch point roller assembly 100 comprises a base plate 101 which comprises a plurality of slots 127Z. The plurality of slots 127Z comprises a first slot 127A and a second slot 127B. The plurality of slots 127Z is configured to enable the switch point roller assembly 100 to be operatively connected to a switch point.

In one aspect, the switch point may be of a shape that is not completely formed of right angles. In other words, the web of the rail may be of a curved shape. In the industry, the rail may be referred to as a Vignoles rail, a T-rail, an asymmetric rail, etc. As such, the rail may have a D-bar which provides an interface to the rail (or switch point) such that the substantially flat surface of the base plate 101 may be operatively connected to the rail (via the D-bar interface). In another aspect, the rail (or switch point) may already be substantially flat and not require a D-bar interface—in which case the base plate 101 may be directly attached to the rail (or switch point) via hardware passing through the plurality of slots 127Z.

As shown, the base plate 101 is substantially flat at the distal and proximal surfaces (as viewed from the axis 103X). However, the base plate 101, in one configuration, may be designed such that the surface of the base plate 101 interfaces directly with any shape of web. Stated differently, the base plate 101 may be a combination of the D-bar and the base plate 101, as instantly shown.

As shown, the base plate 101 is depicted without associated hardware to operatively connect the base plate 101 with the switch point. One of skill in the art will appreciate that various bolts, nuts, locking washers, washers, screws, etc. may be utilized to attach the switch point roller assembly 100 to the switch point. In one aspect, the base plate 101 may be permanently attached to the switch point (e.g., via welding).

The switch point roller assembly 100 further comprises a housing 102 which is generally configured to house a roller 105. The roller 105 may be made from polymer, polyester, urethane, hardened steel, sealed glass (with a nylon interior), etc. The material chosen may further depend on the operating environment as well as the implementation considerations (e.g., cost). The roller 105 provides for the movement of the switch point across the railway plate during transitions of the switch point caused by a switch machine. Therefore, when the switch point is under load from railway stock, the roller 105 provides for rotational movement of the switch point roller assembly 100.

The housing 102 substantially houses an axle retainer 108 that is operatively connected to an axle 109 (which is not visible in the instant view). The axle 109 is operatively connected to the roller 105 such that, again, the roller 105 may roll across the railway plate when the switch point is either moving or under load from rolling stock. One advantage of the configuration of the axle retainer 108 and the housing 102 is to substantially protect the moving parts associated with the roller 105 (e.g., needle bearings, bushings, retaining rings, etc.). Further, the housing 102 enables retention of the axle 109, as will be shown in subsequent views.

The housing 102 is operatively connected to an axle 107 which protrudes from the housing 102. The axle 107 is retained by a plurality of retaining rings 106Z (which comprises a first retaining ring 106A and a second retaining ring 106B). Retaining rings may be referred to as "lock rings" or "locking rings" in the industry. The plurality of retaining rings 106Z is generally configured to retain the axle 107 which protrudes from the housing 102 at a protrusion 112 (not shown in the instant view). The instant view does not show an internal protrusion of the base plate 101 that provides a pivot about which the housing 102 may move. That stated, the axle 107 passes through the protrusion 112 and operatively connects the housing 102 to the base plate 101 (via the axle 107).

The housing 102 is configured to rotate about the axle 107 such that the roller 105 maintains contact with the railway plate, upon which the switch point frequently rests (via the switch point roller assembly 100 as a whole). This contact is maintained, in part, by force created by a spring 111 (not shown) that affects the rotation about the axle 107.

The roller 105 is adjusted via a bolt 114. The bolt 114 comprises an internal hex head 114A, a first segment 114B, a second segment 114C (not shown), and a third segment 114D (not shown). The internal hex head 114A enables the adjustment of the bolt 114 that is operatively connected to the axle retainer 108. The bolt 114 is generally configured to enable adjustment of the axle retainer 108 (and associated roller 105) in order provide effective rolling of the switch point roller assembly 100 at the railway plate.

The housing 102 comprises a first plurality of surfaces 140Z. The first plurality of surfaces 140Z comprises a first surface 140A, a second surface 140B, a third surface 140C, and a fourth surface 140D. The plurality of surfaces 140Z provides a partial enclosure of the bolt 114 and the nut 113 (both of which may be considered a bolt assembly 130), specifically the surfaces 140B, 140C, 140D.

As stated, railway operating environments have many hazards, both mechanical and environmental. Objects may strike track elements and cause damage. The surfaces 140B, 140C are configured to deflect objects away that may strike the bolt assembly 130 from the direction of travel of rolling stock (along the axis 103Y). For example, a dragging chain would be deflected away from the hex head 114A of the bolt 114 by the surface 140C. One particular advantage of the partial enclosure is that the bolt assembly 130 is still serviceable by tools. Further, the bolt assembly 130 is still subject to visual inspection without removal of a hood or cap at the housing 102.

Railway tracks are routinely serviced via two processes that are particularly hazardous to equipment and components at or near the rails. The first is tamping which is the process of adjusting the ballast at or near the track. In many railways, the ballast comprises heavy rock that is moved into position and tamped for stability. As such, the rocks (and other substrate) are distributed to undesirable places in the track (e.g., a rock falling between a switch point). To clean up the ballast, a brushing process is utilized to mechanically brush excess ballast out of the track. In short, the tamping and brushing process are harsh on railway components.

Therefore, the surfaces 140B, 140C, 104D are configured to protect the bolt assembly 130 from these tamping and brushing processes. One of skill in the art will appreciate that the bolt assembly 130 may have sensitive adjustments that a tamping machine and/or a brushing machine may inadvertently damage—or simply cause the bolt assembly 130 to become unaligned.

The housing 102 comprises a plurality of surfaces 155Z at the ventral surface of the housing. The plurality of surfaces 155Z comprises a first surface 155A and a second surface 155B (not shown in the instant view). The plurality of surfaces 155Z is disposed lower to partially protect the roller 105. As stated, railway operating environments are hazardous. The plurality of surfaces 155Z is configured to partially protect the roller 105 from damage. Further, the plurality of surfaces 155Z is configured to protect the axle 109 and the axle retainer 108. Additionally, the plurality of surfaces 155Z is configured to retain the axle 109 without additional hardware, if so configured.

The bolt 114 may be locked via a nut 113 at the surface 140A of the housing 102. Additional hardware may be used to fix the bolt 114 in position (e.g., locking washers, washers, retaining rings, etc.).

Figure 1B:
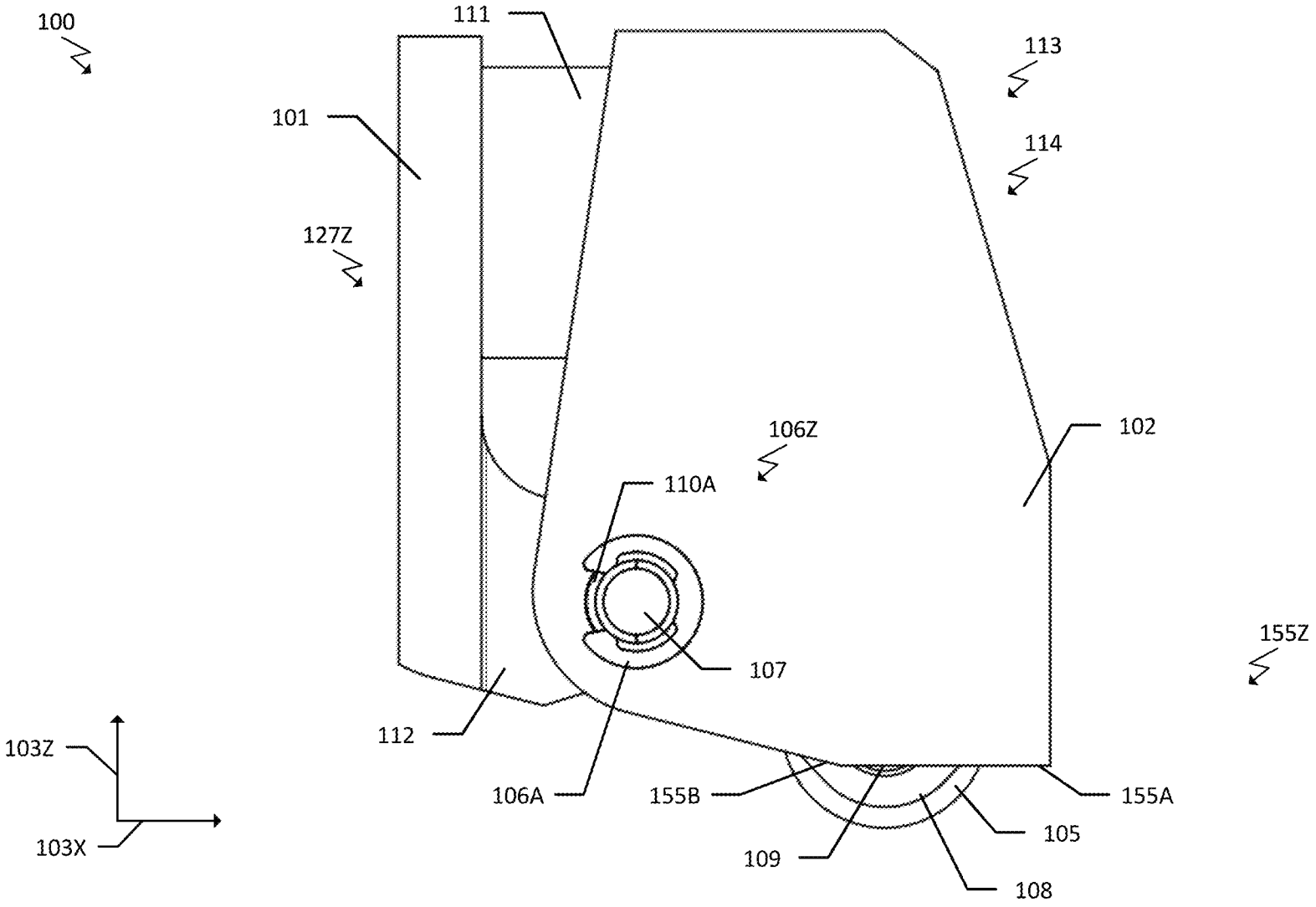
FIG. 1B is a planar view of a switch point roller assembly, as shown from a side perspective.

FIG. 1B is a planar view of a switch point roller assembly 100, as shown from a side perspective. The instant view more clearly shows the spring 111 in contact between the base plate 101 and the housing 102. The housing 102 is configured to interact with the forces associated with the spring 111 in order to cause the roller 105 to maintain contact with the railway plate.

The spring 111 is shown as a synthetic material (e.g., polyester). Polyester has the advantage of being relatively inexpensive while still providing the forces necessary to enable the roller 105 to maintain contact with the railway plate. One of skill in the art will appreciate that the spring 111 is resilient to corrosion when made of polymer, polyester, urethane, etc. Further, such materials are easily recognized in a degraded state via visual and/or physical inspection.

However, the spring 111 may be of other materials depending on the environment and/or implementation factors. For example, the spring 111 may be based on Belleville washers that are metal. If the Belleville washers are fashioned from a stainless steel, the corrosion risk may be mitigated. Belleville washers, however, may fail catastrophically if one or more washers crack, corrode, and/or degrade. Therefore, polymer-based springs have an advantage of being potentially resilient to failure. Other mechanical springs may be utilized beyond the scope of this disclosure (e.g., coil springs, Belleville washers, etc.).

The axle 107 passes through the protrusion 112 on the base plate 101. The nature of the spring 111, the protrusion 112, and the axle 107 enable a pivoting motion of the housing 102, which, in turn, enables the rolling movement of the roller 105 against the railway plate.

One of skill in the art will appreciate that the spring 111 is substantially protected from damage which may be caused by railway maintenance operations. For example, railway tracks are often cleaned by machinery that relies on brushing operations that may damage sensitive moving parts. The spring 111 is one such component that may be otherwise damaged. However, the configuration of the housing 102 and base plate 101 enables the spring 111 to be substantially protected from damage while still enabling access to the spring 111 for typical maintenance operations and checks.

The surfaces 155A, 155B are shown in more detail in the instant view. The axle 109 is partially covered by the parallel plane of the surface 155A. Further, the axle retainer 108 is partially covered by each of the parallel planes formed by the surfaces 155A, 155B, respectively. One of skill in the art will appreciate that the surfaces 155A, 155B are configured to be closer to where the contact of the roller 105 and the railway plate occurs. This proximity enables the roller 105 to move freely while protecting the roller 105, the axle 109, and the axle retainer 108 from damage and hazards. One advantage of this configuration is to enable such protection while still enabling visual inspection as well as maintenance operations. Further, this configuration enables the axle 109 to be retained by the axle retainer 108 without the need of additional hardware (e.g., locking washers).

Figure 1C:
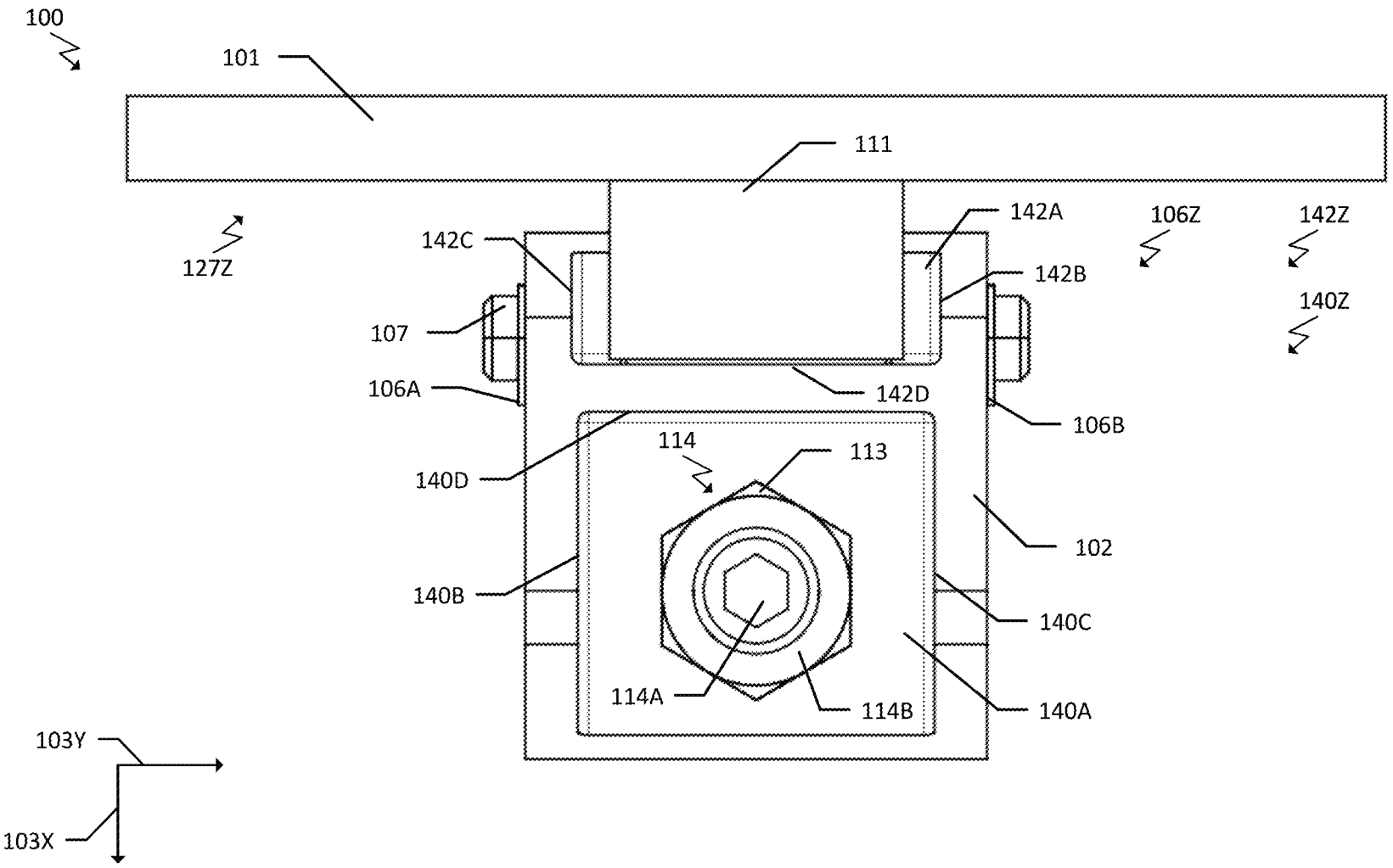
FIG. 1C is a planar view of a switch point roller assembly, as shown from a top perspective.

FIG. 1C is a planar view of the switch point roller assembly 100, as shown from a top perspective. The instant view shows the spring 111 being in contact with both the base plate 101 and the housing 102. The spring 111 is slightly disposed below the surface of the base plate 100; however, this aspect is not clearly shown in the instant view but will be shown in subsequent views.

One advantage of the housing 102 is that the bolt 114 and nut 113 are protected from damage, as stated above at FIG. 1A. The instant view clearly shows that said protection is not at the expense of ready access to the bolt 114 and nut 113. One of skill in the art will appreciate the clearance provided by the housing 102 that enables access to both the internal hex head 114A and the nut 113. Therefore, the configuration of the bolt 114 and the housing 102 strikes a balance between robust operation and ease of adjustment.

The housing 102 comprises a second plurality of surfaces 142Z. The second plurality of surfaces 142Z comprises a first surface 142A, a second surface 142B, a third surface 142C, and a fourth surface 142D. As with the plurality of surfaces 140Z, the plurality of surfaces 142Z provides protection for the spring 111. As stated above, track components are subject to extreme operational conditions. The spring 111 is no exception and may be struck by objects or inadvertently damaged by maintenance equipment (e.g., brushing machines). To mitigate damage, the surfaces 142B, 142C are particularly configured to protect against damage from objects moving parallel to the rolling stock (along the axis 103Y).

As with the plurality of surfaces 140Z, the plurality of surfaces 142Z is configured to enable easy visual inspection and service of the spring 111. In one aspect, the spring 111 may be a synthetic material that is relatively low-cost and readily replaceable. With minimal effort, maintenance personnel can replace the spring 111 based on a quick visual inspection.

The surface 142D acts to provide a reciprocal surface to the base plate 101 with respect to the spring 111. The housing 102 is configured to move along the axis 103X under load, and the spring 111 is configured to manage this force to enable roller 105 to maintain substantial contact with the railway plate.

Figure 1D:
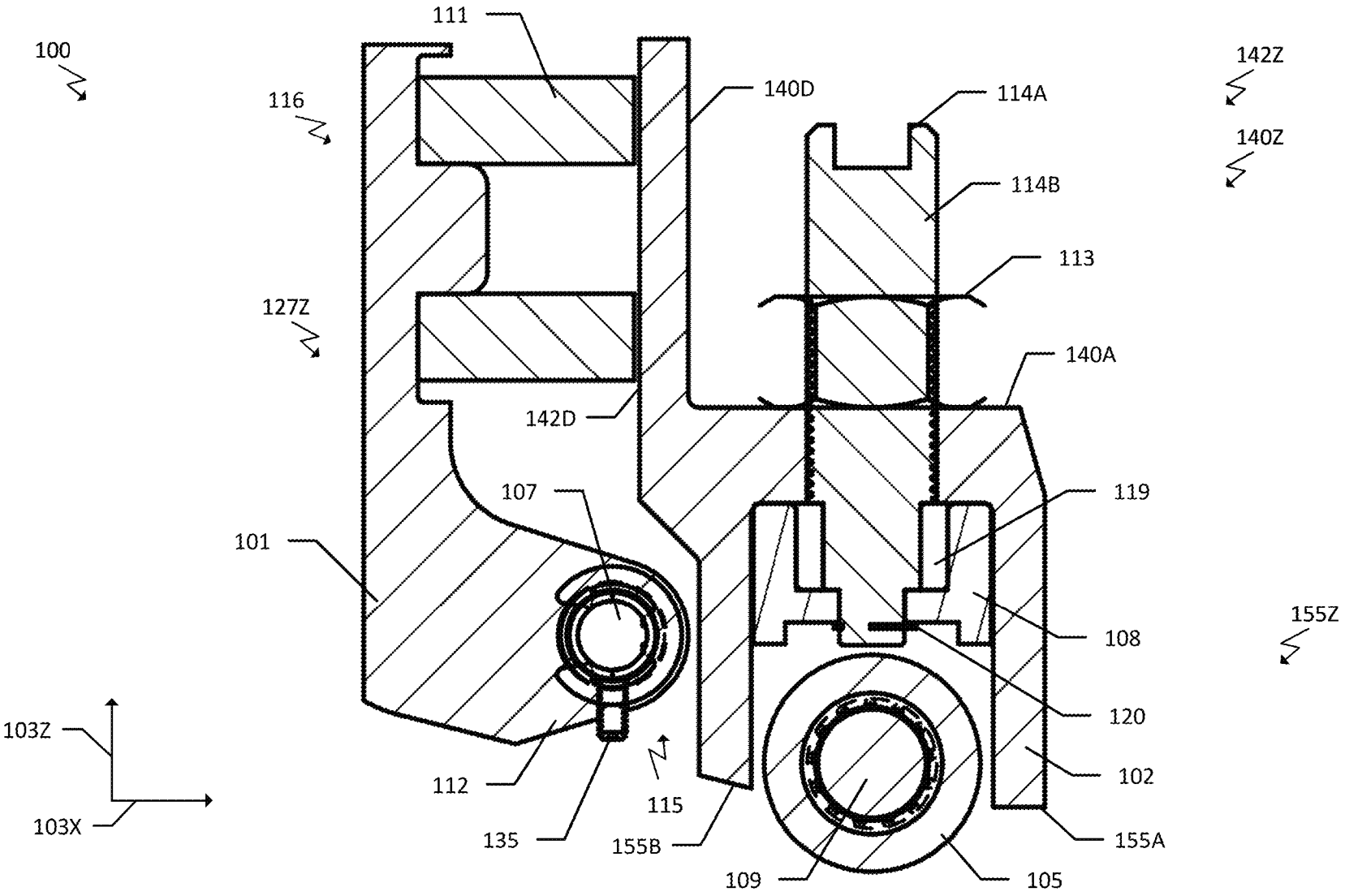
FIG. 1D is a planar view of a switch point roller assembly, as shown from a side perspective.

FIG. 1D is a planar view of a switch point roller assembly, as shown from a side perspective. The instant view depicts the switch point roller assembly 100 in a cutaway in order to better highlight components. The spring 111 is shown in contact with the base plate 101. The base plate 101 comprises a spring support 116. The spring support 116 is configured to be below the surface of the base plate 101, in part, to stabilize the spring 111 during movement operations of the switch point and the switch point roller assembly 100 as a whole.

The axle 107 is shown in more detail within the protrusion 112. The protrusion comprises a hole 115. A set screw 135 is shown within a threaded hole 133. The threaded hole 133 is perpendicular to the hole 115. When the axle 107 is disposed within the hole 115 (parallel to the axis 103Y), the set screw 135 is configured to be in contact with the axle 107 in order to reduce rotation of the axle 107 within the hole 115. Without the set screw 135 engaged, the axle 107 may internally rotate within the hole 115.

The instant view shows the surfaces 155A, 155B being configured to partially cover the axle 109, the axle retainer 108, and the roller 105. Again, this configuration of the housing 102 enables the axle 109 to be retained without additional hardware (e.g., retaining rings). Likewise, the housing 102 partially protects the roller 105, the axle 109, and the axle retainer 108.

Figure 2A:
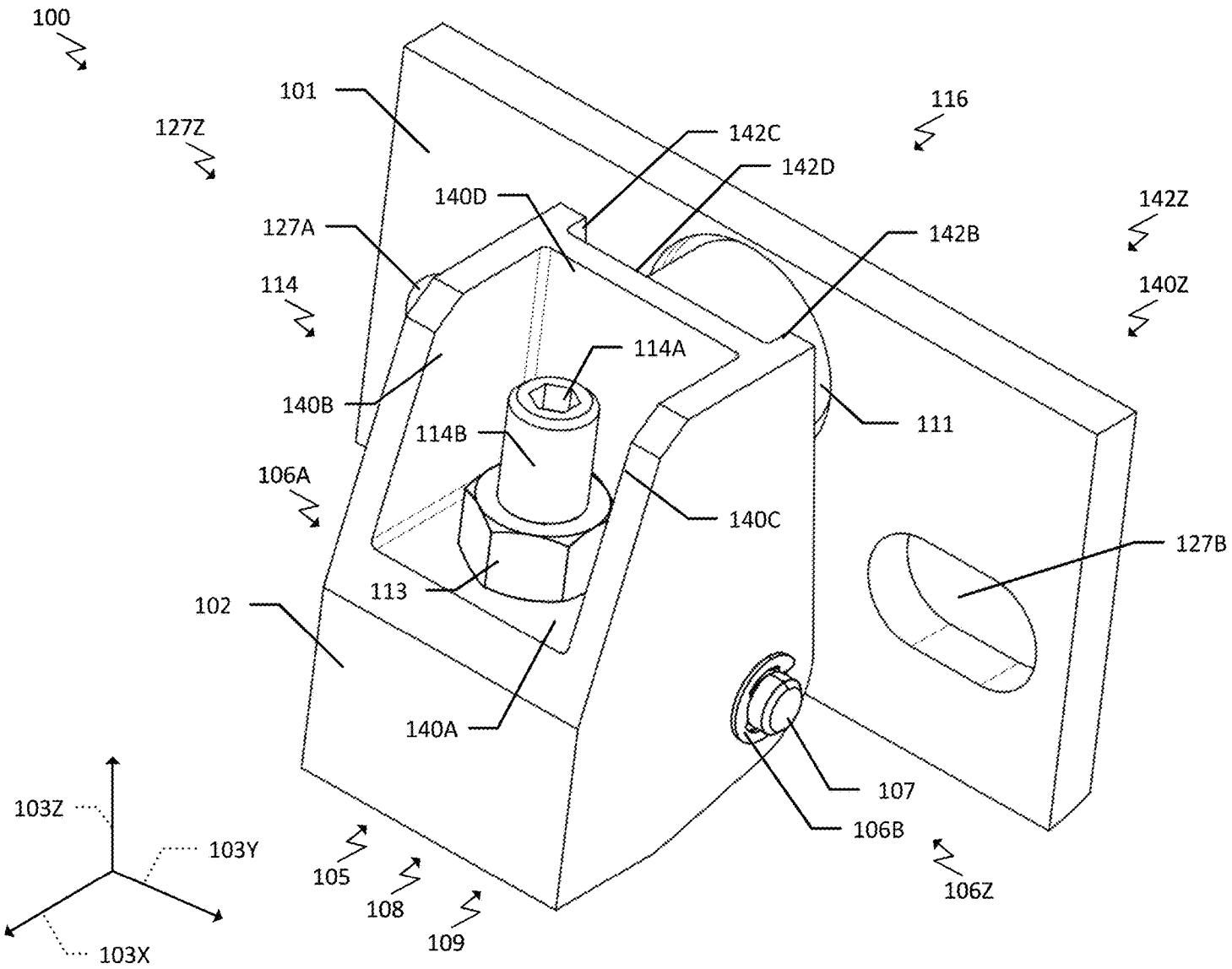
FIG. 2A is a perspective view of a switch point roller assembly, as shown from a top perspective.

FIG. 2A is a perspective view of the switch point roller assembly 100, as shown from a top perspective. The instant view more clearly depicts the spring 111 being disposed at the spring support 116.

Figure 2B:
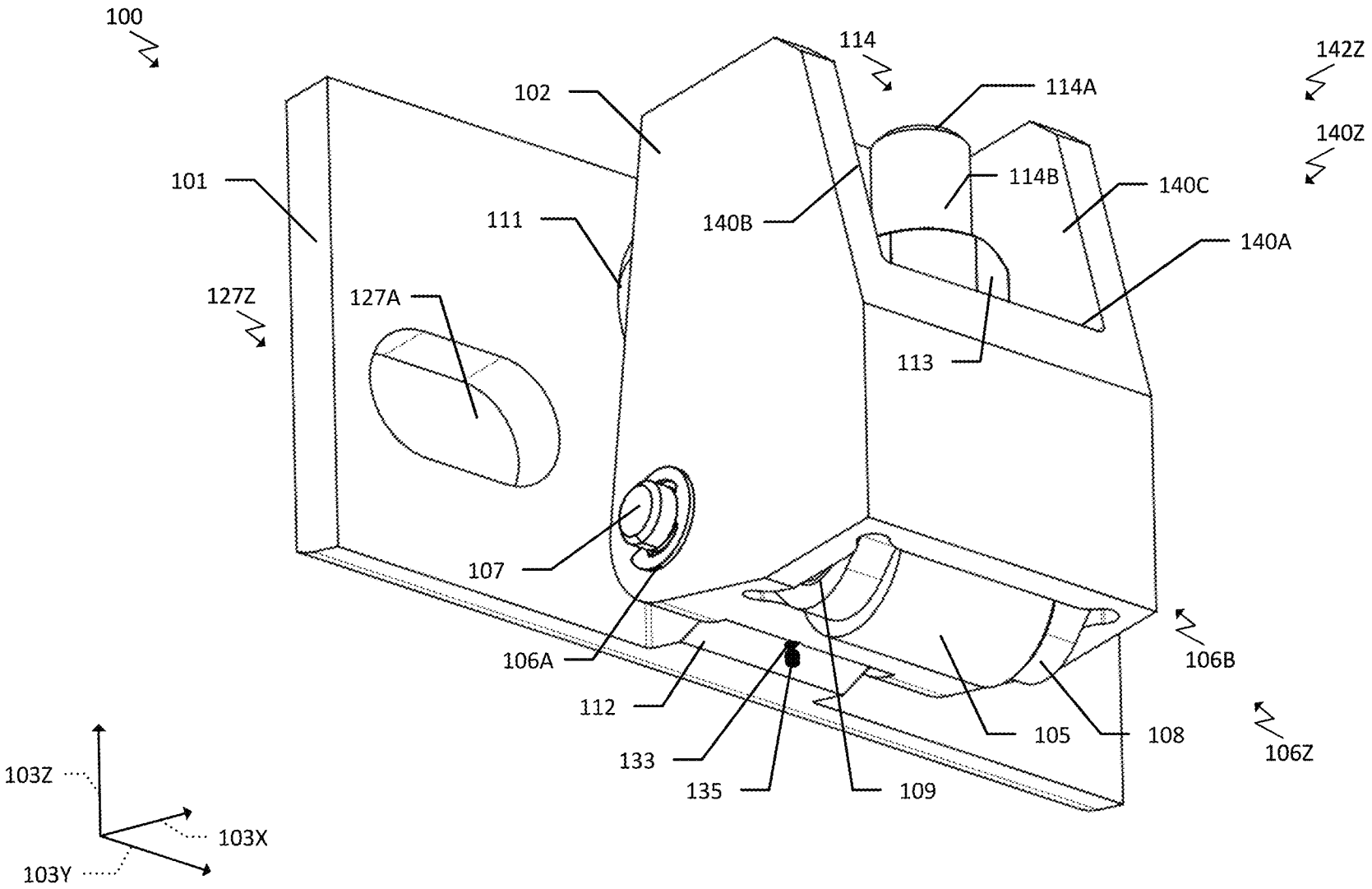
FIG. 2B is a perspective view of a switch point roller assembly, as shown from a bottom perspective.

FIG. 2B is a perspective view of the switch point roller assembly 100, as shown from a bottom perspective. The instant view shows the roller 105 in better detail such that the axle 109 is shown within the associated axle retainer 108. The axle retainer 108 is configured to hold the axle 109 using the interior of the housing 102. This configuration provides for retention of the axle 109 with a reduced reliance on set screws, locking washers, retaining rings, threading, etc.; to be clear, one of skill in the art may still rely on such additional hardware, depending on the deployment considerations. Further, this configuration of the housing 102 provides enhanced protection of components within the housing 102 (e.g., the roller 105).

Additionally, the configuration of the housing 102 enables the bolt 114 to be adjusted to provide access to the roller 105, the axle 109, and the axle retainer 108. For example, the nut 113 may begin in a tightened state to hold the bolt 114 in place. To adjust the bolt 114, the nut 113 may be first loosened (or completely removed). Next, the bolt 114 may be adjusted and/or removed entirely, thus allowing the axle retainer 108 to freely drop from the housing 102. When removed, the axle retainer 108 may allow the removal of the axle 109 and the roller 105. These operations enable the service and/or replacement of these moving parts such that the switch point roller assembly 100 may be serviced during a given duty cycle with ease. Thus, the switch point roller assembly 100 provides for enduring means for providing safe operation of switch points.

The instant view shows in detail the threaded hole 133 within the protrusion 112. The threaded hole 113 is configured to receive the set screw 135. The set screw 135 may have a hex head in one aspect. The set screw 135 may be adjusted to reduce rotation of the axle 107 when the roller 105 moves substantially along the axis 103X during operation of the switch point roller assembly 101. One of skill in the art will appreciate that the set screw 135 enables the service and replacement of component parts (e.g., the axle 107).

Figure 3A:
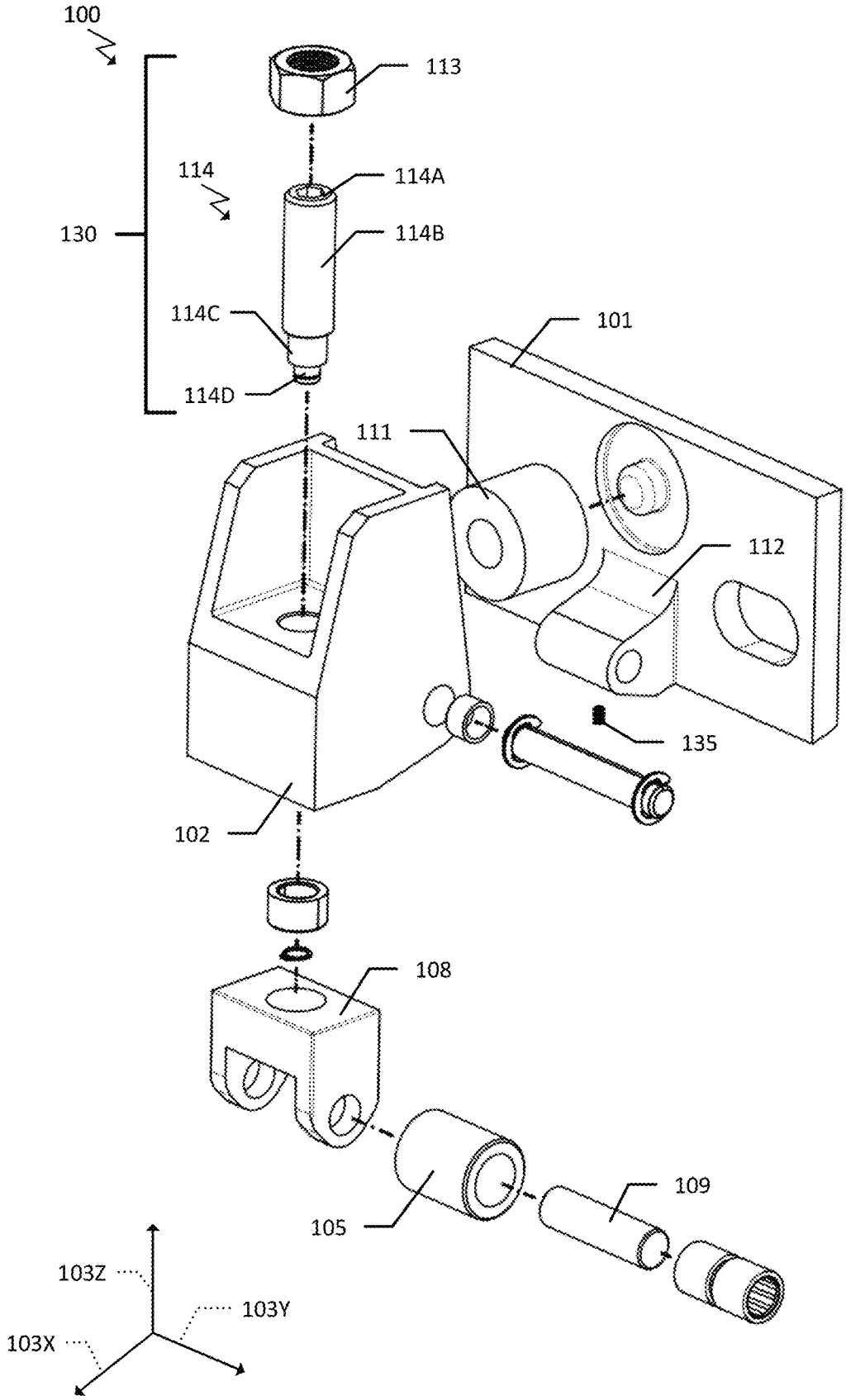
FIG. 3A is a perspective view of a switch point roller assembly, as shown exploded and from a top perspective.

FIG. 3A is a perspective view of the switch point roller assembly 100, as shown exploded and from a top perspective. The instant view more clearly shows the bolt assembly 130 which comprises the bolt 114 and the nut 113. The bolt 114 comprises the internal hex head 114A, as disclosed above. The segment 114B is externally threaded. The segment 114C is not threaded and has a reduced diameter from the segment 114B in order to accommodate a bushing. The segment 114D has a further reduced diameter and accommodates a retaining ring.

Figure 3B:
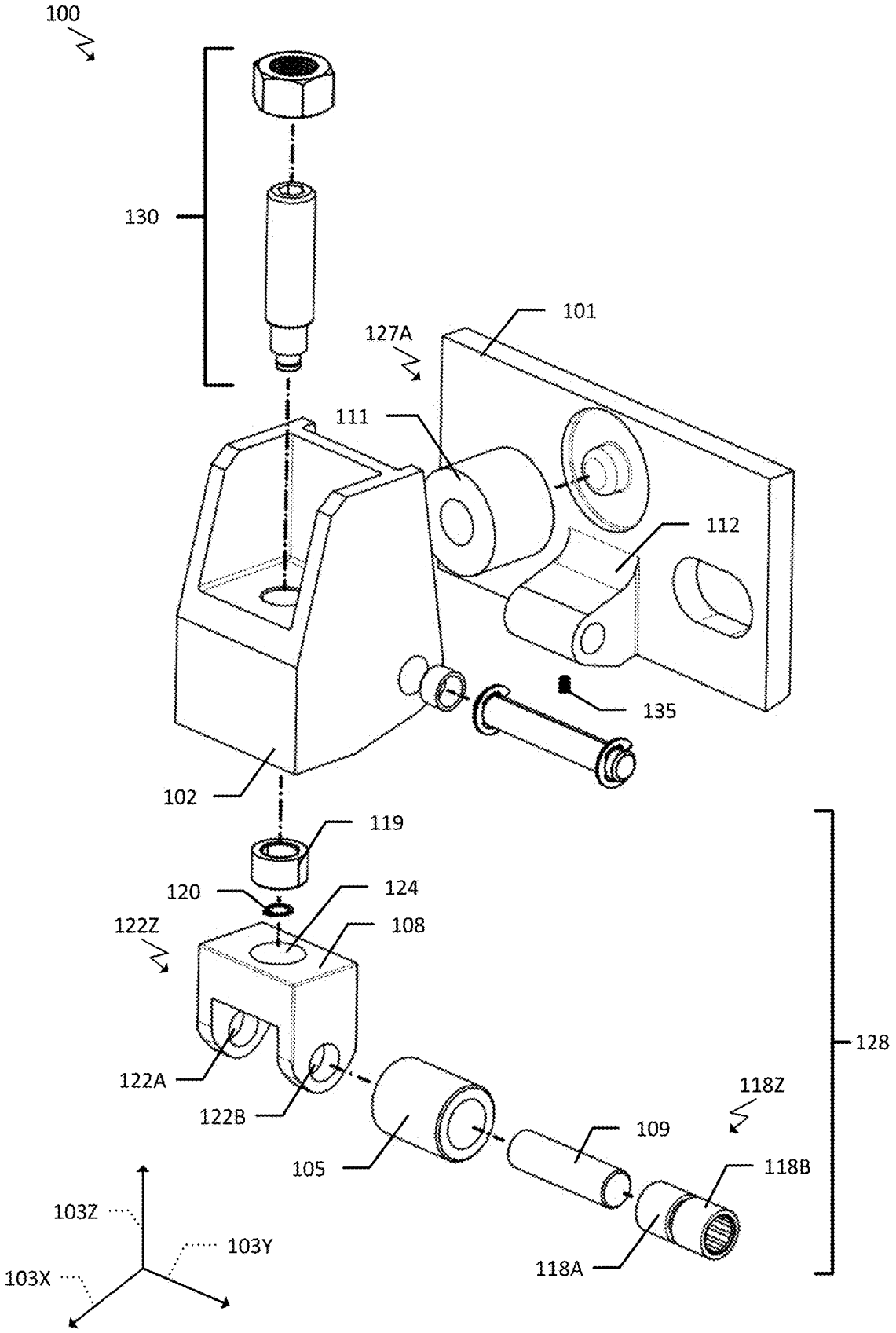
FIG. 3B is a perspective view of a switch point roller assembly, as shown exploded and from a top perspective.

FIG. 3B is a perspective view of the switch point roller assembly 100, as shown exploded and from a top perspective. The instant view depicts a roller assembly 128 in more detail. The roller assembly 128 comprises a plurality of needle bearings 118Z, the axle 109, the roller 105, the axle retainer 108, a retaining ring 120, and a bushing 119. The plurality of needle bearings 118Z comprises a first needle bearing 118A and a second needle bearing 118B. The plurality of needle bearings 118Z is generally configured to enable the rolling of the roller 105 about the axle 109.

The axle retainer 108 comprises a plurality of holes 122Z and a hole 124. The plurality of holes 122Z is comprised of a first hole 122A and a second hole 122B. The plurality of holes 122Z enables the retention of the axle 109. Again, said retention is advantageous because the housing 102 itself provides stability of the axle 109 in the direction of the axis 103Y. As such, set screws are not required to retain the axle 109. The hole 124 is generally configured to provide an interface between the bolt assembly 130 and the roller assembly 128.

Figure 3C:
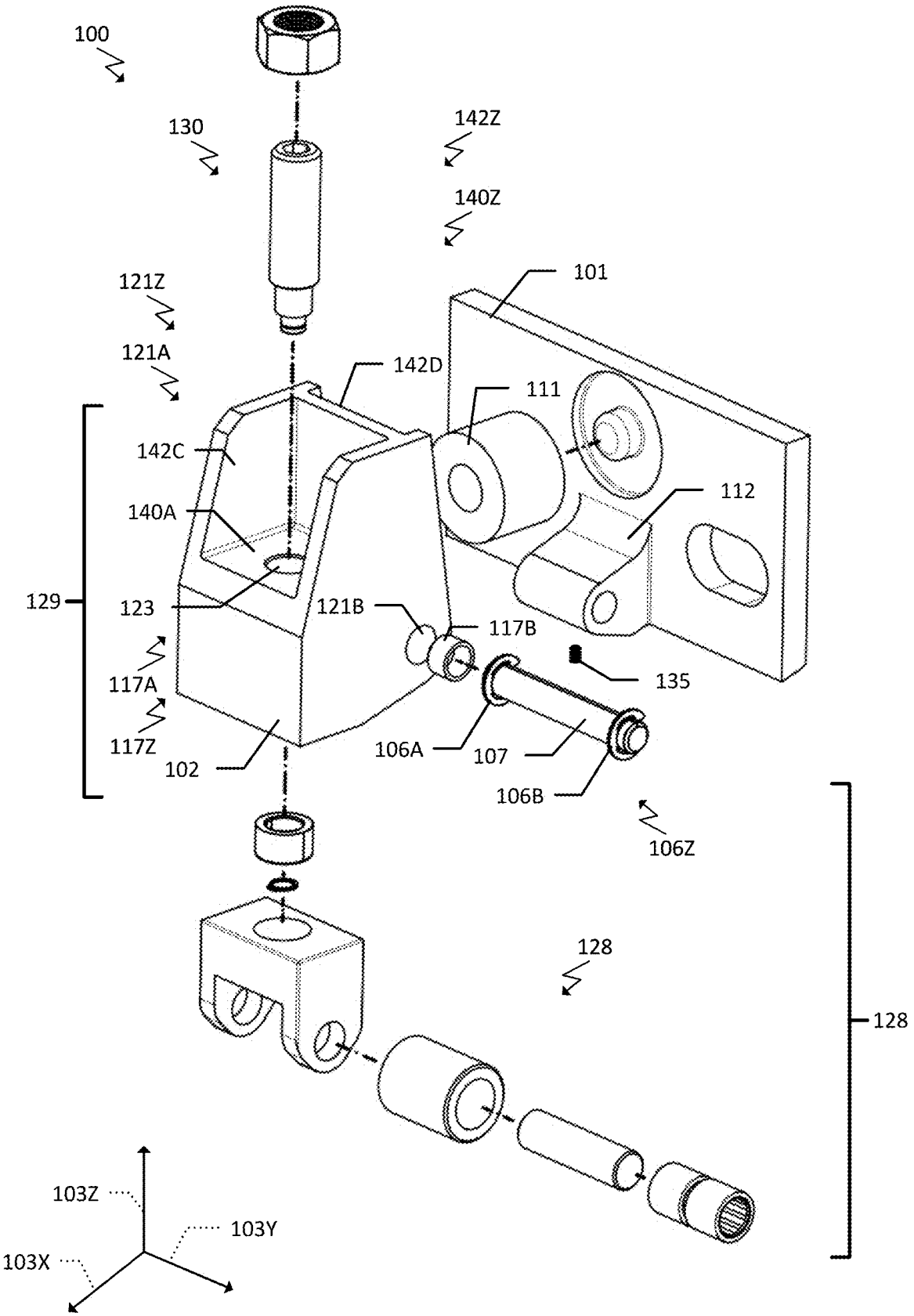
FIG. 3C is a perspective view of a switch point roller assembly, as shown exploded and from a top perspective.

FIG. 3C is a perspective view of the switch point roller assembly 100, as shown exploded and from a top perspective. The instant view more clearly depicts a housing assembly 129. The housing assembly 129 comprises the axle 107, the plurality of retaining rings 106Z, a plurality of bushings 117Z, and the set screw 135. The plurality of bushings 117Z comprises a first bushing 117A (obscured in the instant view) and a second bushing 117B. The plurality of bushings 117Z is generally configured to support the axle 107.

The housing 102 comprises the surface 140A, a hole 123, and a plurality of holes 121Z. The plurality of holes 121Z comprises a first hole 121A (obscured in the instant view) and a second hole 121B. The hole 123 is threaded and accommodates the bolt assembly 130 in order to operatively connect the roller assembly 128 to the housing assembly 129. The plurality of holes 121Z is generally configured to support the axle 107 (via the plurality of bushings 117Z).

Figure 3D:
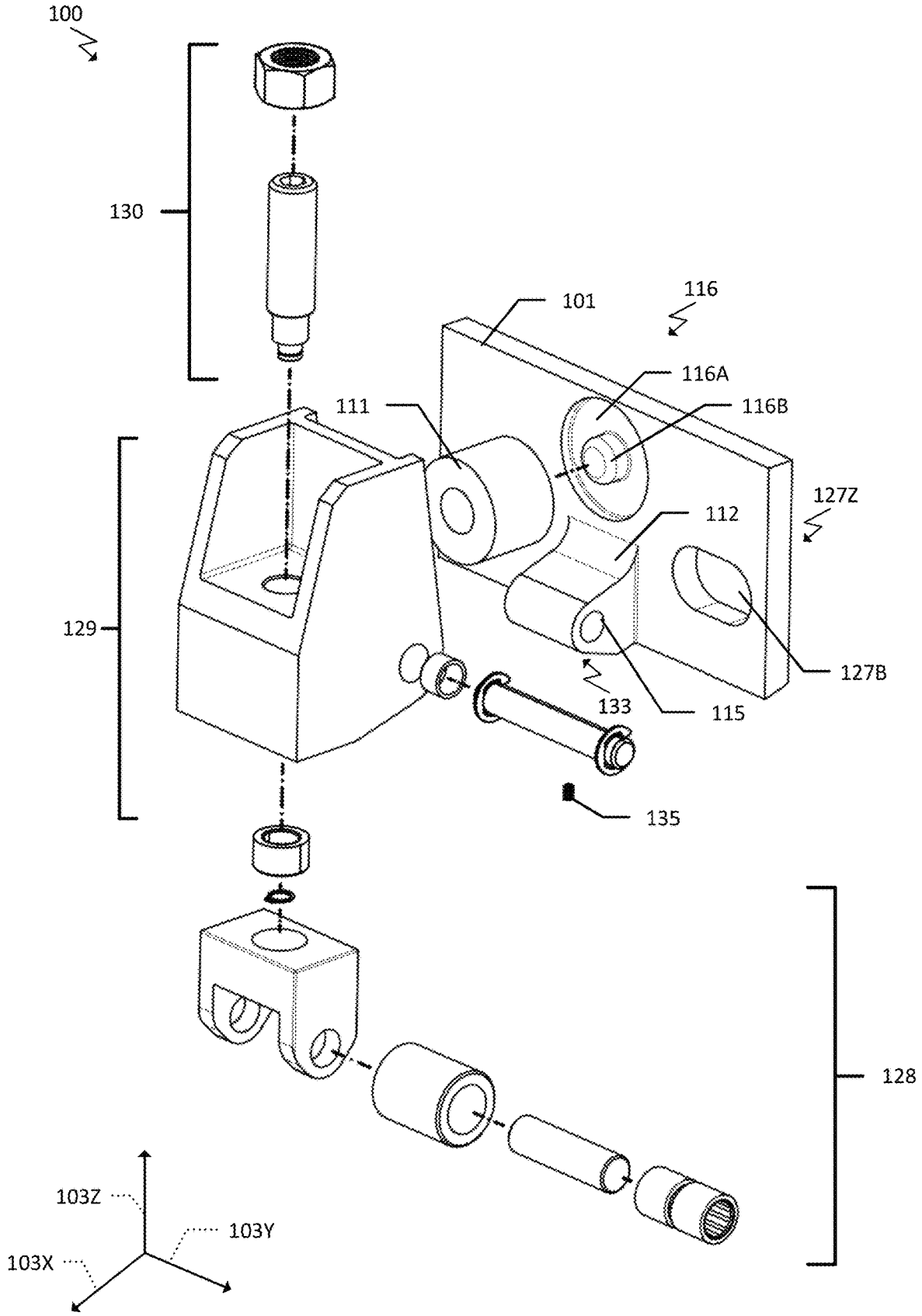
FIG. 3D is a perspective view of a switch point roller assembly, as shown exploded and from a top perspective.

FIG. 3D is a perspective view of the switch point roller assembly 100, as shown exploded and from a top perspective. The instant view shows the base plate 101 in more detail. The base plate 101 comprises the spring support 116, the plurality of slots 127Z, the protrusion 112, the hole 115, and the threaded hole 133. The spring support 116 is generally configured to provide force interactions (via the spring 111) between the base plate 101 and the housing assembly 129. The spring support 116 comprises an outer spring support 116A and an inner spring support 116B. The outer spring support 116A is generally configured to support the spring 111 at the outer circumference of the spring 111. The inner spring support 116B is generally configured to support the spring 111 at the inner circumference of the spring 111 and to prevent the spring 111 from dislodging.

The protrusion 112 comprises the hole 115. The hole 115 is generally configured to enable the axle 107 to pass through the protrusion 112 in order to operatively connect the housing assembly 129 to the base plate 101. The threaded hole 133 is configured to accept the set screw 135 which is used to reduce rotation of the axle 107 within the hole 115. As stated above, the threaded hole 133 is oriented along the axis 103Z and intersects with the hole 115.

Figure 4:
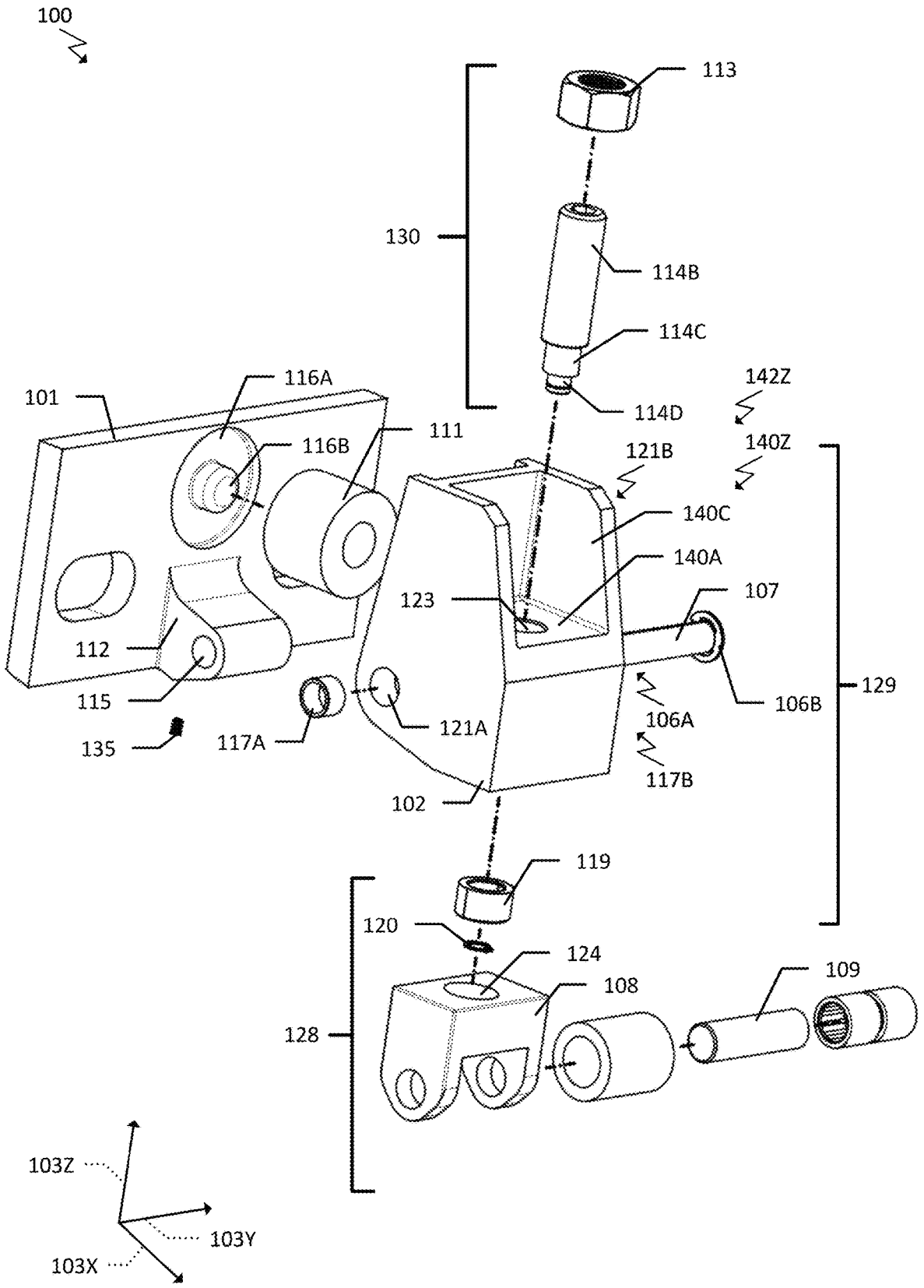
FIG. 4 is a perspective view of a switch point roller assembly, as shown exploded and from a top perspective.

FIG. 4 is a perspective view of the switch point roller assembly 100, as shown exploded and from a top perspective. The instant view more clearly depicts the combination of the base plate 101, the spring 111, the bolt assembly 130, the roller assembly 128, and the housing assembly 129. Further, the instant view is at a slightly different angle than that of the FIGS. 3A-3D in order to highlight various aspects of the switch point roller assembly 100. An additional high-level summary of key aspects follows.

The base plate 101 is operatively connected to the spring 111 at both the outer spring support 116A and the inner spring support 116B. Likewise, the spring 111 is in contact with the housing 102. Said contact enables the roller 105 to maintain substantial contact with the railway plate.

The housing assembly 129 is operatively connected to the base plate 101 via the protrusion 112 via the hole 115. Specifically, the axle 107 passes through the hole 121A, the bushing 117A, the hole 115, the bushing 117B, and the hole 121B. The retaining rings 106A, 106B are affixed to the axle 107 to retain the housing 102 to the base plate 101 (via the protrusion 112 and the hole 115). The set screw 135 may engage via the threaded hole 133 to reduce rotation of the axle 107.

The roller assembly 128 is operatively connected to the housing assembly 129 via the bolt assembly 130. The bushing 119 is disposed in the hole 124. The bolt assembly 130 is generally disposed in the hole 123. The bolt segment 114D is operatively connected to the locking ring 120. The bolt segment 114C is disposed at the inside of the bushing 119. The bolt segment 114B is disposed on the dorsal surface of the bushing 119. The internal hex head 114A is used to secure and/or adjust the roller assembly 128 with respect to the housing assembly 129. The nut 113 may then be used to secure the bolt assembly 130—in turn, securing the roller assembly 128 to the housing assembly 129 at the surface 140A.

The instant view shows the housing 102 is configured to retain the axle 109 of the roller assembly 128. One of skill in the art will note that the axle 109 is configured, in one aspect, to avoid the need for additional hardware for the retention of the axle 109. For instance, locking/retaining rings are not required. While the instant view depicts the axle 109 without locking/retaining rings, one of skill in the art may still desire such retention mechanisms without departing from the capability of the housing 102 to substantially retain the axle retainer 108 and the axle 109 without additional hardware.

Figure 5A:
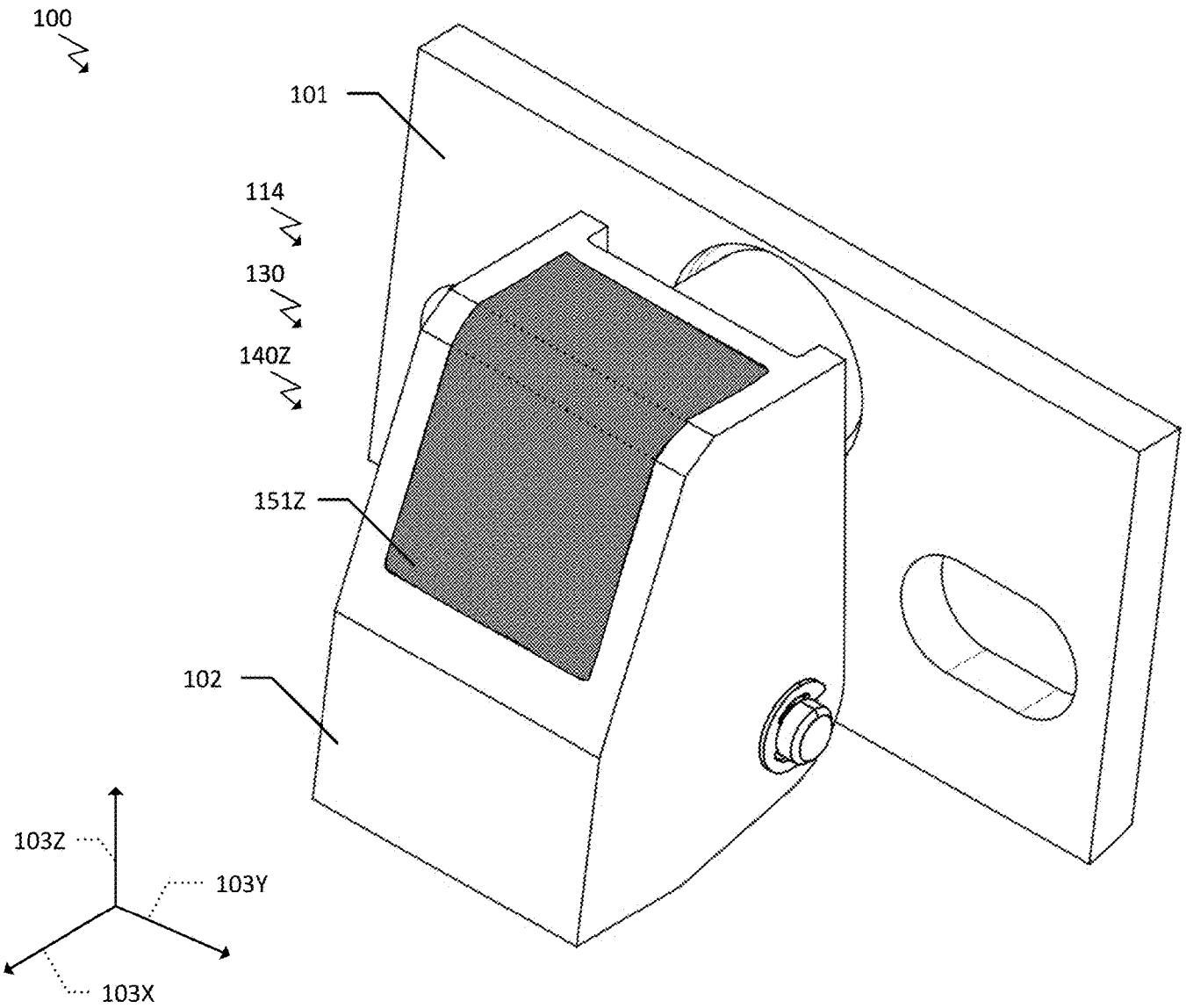
FIG. 5A is a perspective view of a switch point roller assembly, as shown from a top perspective.

FIG. 5A is a perspective view of the switch point roller assembly 100, as shown from a top perspective. The instant view is provided to emphasize that the plurality of surfaces 140Z partially protect the bolt assembly 130. The plurality of planes 151Z shows how the bolt 114 is below the plurality of planes 151Z within the housing 102. As stated, this configuration enables the bolt assembly 130 to be adjusted, inspected, maintained, etc. while not sacrificing necessary protection from environmental and/or mechanical hazards.

Figure 5B:
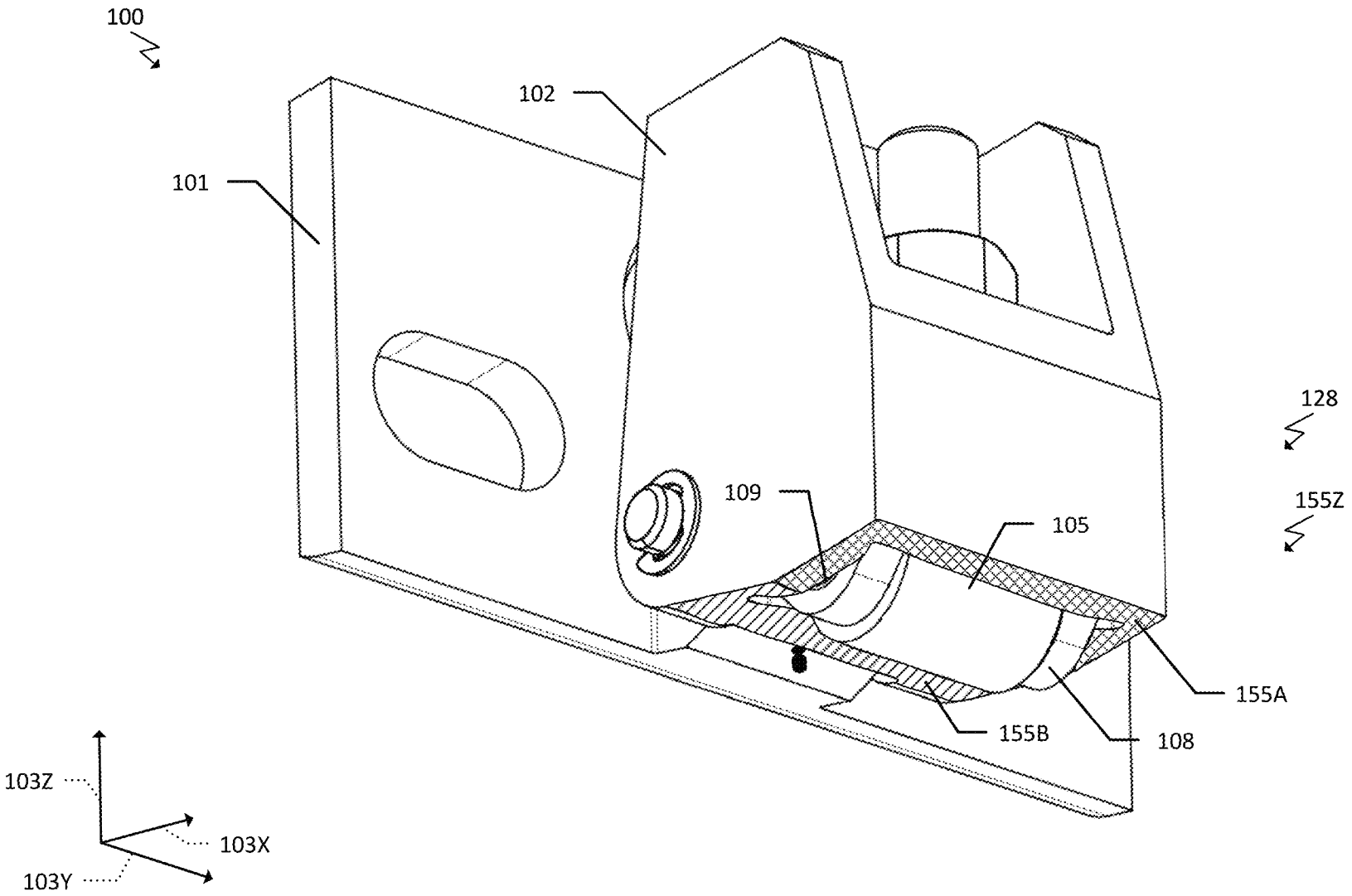
FIG. 5B is a perspective view of a switch point roller assembly, as shown from a bottom perspective.

FIG. 5B is a perspective view of the switch point roller assembly 100, as shown from a bottom perspective. The instant view is provided to emphasize the plurality of surfaces 155Z being configured to partially protect the roller 105, the axle 109, and the axle retainer 108. As stated, railway operating environments introduce many hazards that cause damage to components. As such, the plurality of surfaces 155Z is positioned to provide coverage without sacrificing the ability to adjust, inspect, maintain, etc. the roller assembly 128 (e.g., the roller 105).

Figure 5C:
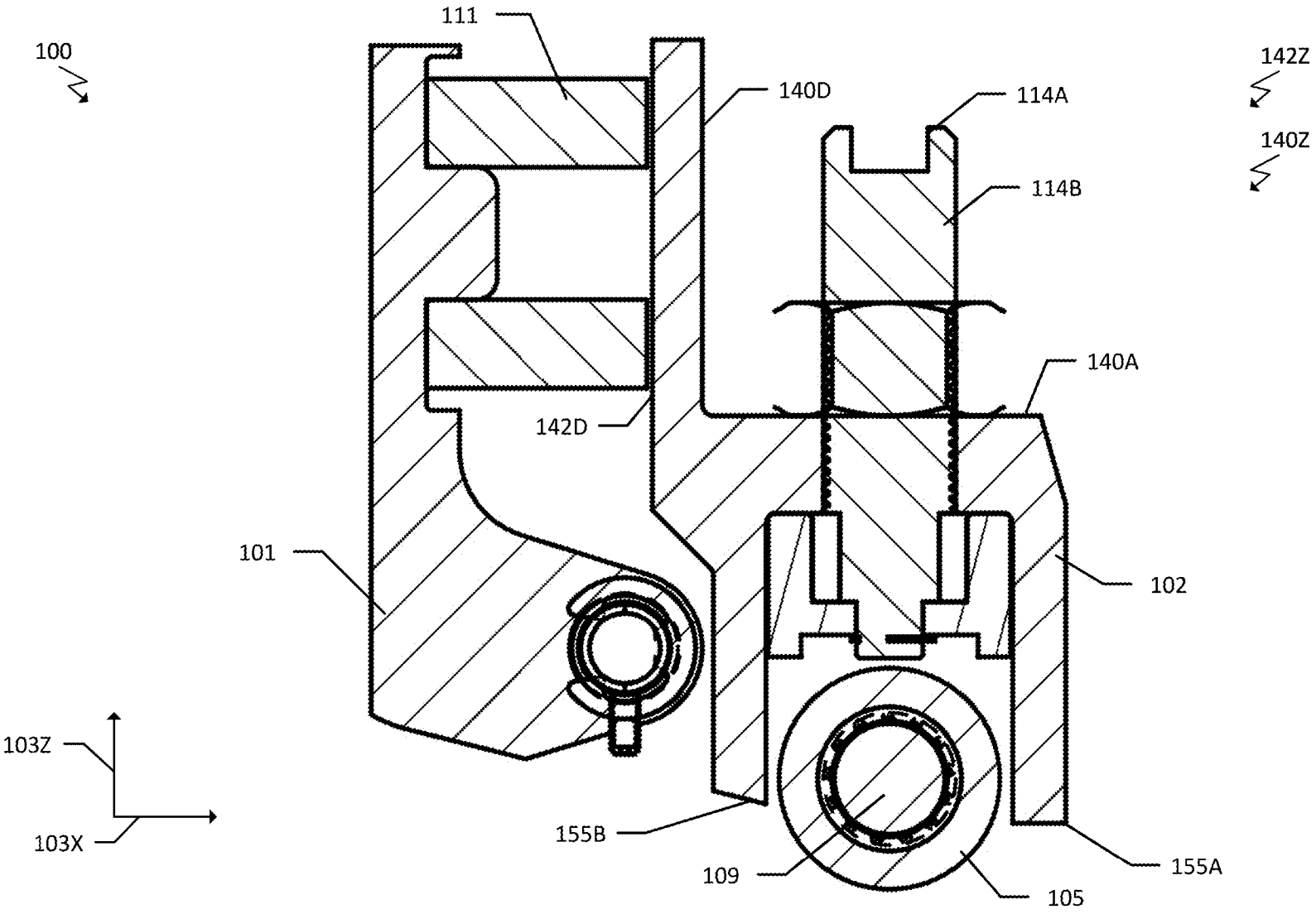
FIG. 5C is a planar, cross-sectional view of a switch point roller assembly, as shown from a side perspective.

FIG. 5C is a planar, cross-sectional view of the switch point roller assembly 100, as shown from a side perspective.

The disclosed solution may be configured as a kit. In one aspect, the kit may comprise the switch point roller assembly 100. In another aspect, the kit may comprise the housing assembly 129. In yet another aspect, the kit may comprise the bolt assembly 130. In still another aspect, the kit may comprise the roller assembly 128. In yet another aspect, the kit may comprise the base plate 101. One of skill in the art will appreciate that such kit configurations may be sold in order to replace components of the switch point roller assembly 100 after being deployed in the field. Additionally, any kit may be included within another kit. For example, the bolt assembly 130 may become damaged during a duty cycle—as such, the kit may include an additional bolt assembly 130 with a packaged switch point roller assembly 100.

The kit may also be configured with a switch and/or a switch point. In one aspect, the switch point roller assembly 100 comprises a switch and one or more switch point roller assemblies 100. Given the advantages of the disclosed solution, having the switch point roller assembly 100 included with a switch kit may be desirable by those in the industry. In another aspect, the kit may comprise a switch point and the switch point roller assembly 100. For example, a replacement switch point may be packaged with the switch point roller assembly 100 to replace a failing switch point—the switch point roller assembly 100 being included to prevent such an event from reoccurring prematurely for the new switch point. In one aspect, the switch point roller assembly 100 may be preinstalled with the switch point. Such preinstallation may be advantageous to reduce deployment time.

In one final aspect, the kit may comprise a railway plate and/or a railway tie. The switch point roller assembly 100 may be packaged in a kit with a railway plate and/or a railway tie. As disclosed herein, a smooth rolling surface for the roller 105 is generally desirable. Having a kit with a new railway plate and/or railway tie may enhance deployment and operation because a new roller is operating with a new railway plate and/or railway tie.

The foregoing method descriptions and diagrams/figures are provided merely as illustrative examples and are not intended to require or imply that the operations of various aspects must be performed in the order presented. As will be appreciated by one of skill in the art, the order of operations in the aspects described herein may be performed in any order. Words such as "thereafter," "then," "next," etc. are not intended to limit the order of the operations; such words are used to guide the reader through the description of the methods and systems described herein. Further, any reference to claim elements in the singular, for example, using the articles "a," "an," or "the" is not to be construed as limiting the element to the singular.

The preceding description of the disclosed aspects is provided to enable any person skilled in the art to make, implement, or use the claims. Various modifications to these aspects will be readily apparent to those skilled in the art, and the generic principles defined herein may be applied to other aspects without departing from the scope of the claims. Thus, the present disclosure is not intended to be limited to the aspects illustrated herein but is to be accorded the widest scope consistent with the claims disclosed herein.

The invention claimed is:

1. A switch point roller assembly (100) configured for operation at or near a switch point of a railway switch, the switch point roller assembly (100) comprising:

a spring (111);

a bolt assembly (130) comprising a bolt (114) and a nut (113), the bolt (114) comprising a hex head (114A), wherein the hex head (114A) provides adjustment of the bolt (114);

a roller assembly (128) comprising a roller (105), an axle retainer (108), and a first axle (109), wherein the axle retainer (108) is operatively connected to the bolt assembly (130), wherein the first axle (109) is disposed within the roller (105) and the axle retainer (108), wherein the roller assembly (128) is adjustable by the bolt assembly (130) via the hex head (114A);

a housing assembly (129) comprising a housing (102), wherein the housing assembly (129) is operatively connected to the roller assembly (128) via the bolt assembly (130), wherein the housing assembly (129) is further operatively connected to the roller assembly (128), wherein the housing (102) comprises a first plurality of surfaces (140Z) and a second plurality of surfaces (142Z), wherein the nut (113) is configured to substantially secure the bolt (114) to a first surface (140A) within the first plurality of surfaces (140Z), wherein the spring (111) is configured to be disposed between a base plate (101) and a second surface (142D) within the second plurality of surfaces (142Z), wherein the housing (102) further comprises a third plurality of surfaces (155Z), wherein the roller assembly (128) is disposed partially within the housing (102) with respect to the third plurality of surfaces (155Z); and the base plate (101) comprising a plurality of slots (127Z) configured to attach the base plate (101) to the switch point, wherein the base plate (101) further comprises a spring support (116), wherein the spring (111) is supported by the spring support (116) and is in contact with the housing assembly (129), the spring support (116) comprising an inner spring support (116B) and an outer spring support (116A), wherein the spring (111) is supported, at an inner diameter of the spring (111), via the inner spring support (116B), wherein the spring (111) is further supported, at an outer diameter of the spring (111), via the outer spring support (116A).

2. The switch point roller assembly (100) of claim 1, wherein the bolt (114) comprises:

a first bolt segment (114B) being a first diameter and threaded;

a second bolt segment (114C) being a second diameter, the second diameter being smaller than the first diameter; and a third bolt segment (114D), the third bolt segment (114D) having a third diameter, the third diameter being smaller than the second diameter.

3. The switch point roller assembly (100) of claim 1, wherein the roller assembly (128) further comprises:

a first bushing (119) in contact with the bolt assembly (130);

a retaining ring (120), the retaining ring (120) retaining the bolt assembly (130) at the axle retainer (108); and a plurality of needle bearings (118Z), the plurality of needle bearings (118Z) providing for rotation of the roller (105) about the first axle (109).

4. The switch point roller assembly (100) of claim 3, wherein the axle retainer (108) comprises:

a first plurality of holes (122Z), the plurality of holes (122Z) supporting the first axle (109); and a first hole (124) accommodating the first bushing (119).

5. The switch point roller assembly (100) of claim 1, wherein the housing assembly (129) comprises:

a plurality of bushings (117Z);

a second axle (107), the second axle (107) being disposed within the plurality of bushings (117Z);

a plurality of retaining rings (106Z), the plurality of retaining rings (106Z) being configured to retain the second axle (107); and a set screw (135), the set screw (135) being configured to be in contact with the second axle (107).

6. The switch point roller assembly (100) of claim 5, the housing (102) further comprising:

a second plurality of holes (121Z), the second plurality of holes (121Z) being configured to accommodate the plurality of bushings (117Z); and a second hole (123), the second hole (123) being configured to accommodate the bolt assembly (130).

7. The switch point roller assembly (100) of claim 1, the base plate (101) further comprising:

a protrusion (112) having a third hole (115), the third hole (115) being configured to accommodate the housing assembly (129), wherein the protrusion (112) further comprises a threaded hole (133), wherein the threaded hole (133) is oriented perpendicularly to the third hole (115) and is configured to receive a set screw (135).

8. The switch point roller assembly (100) of claim 1, wherein the spring (111) is polymer, polyester, urethane, hardened steel, or a combination thereof.

9. The switch point roller assembly (100) of claim 1, wherein the roller (105) is polymer, polyester, urethane, hardened steel, sealed glass having a nylon interior, or a combination thereof.

10. A kit configured for operation at or near a railway switch, the kit comprising:

a switch point; and a switch point roller assembly (100), comprising:

a spring (111);

a bolt assembly (130) comprising a bolt (114) and a nut (113), the bolt (114) comprising a hex head (114A), wherein the hex head (114A) provides adjustment of the bolt (114);

a roller assembly (128) comprising a roller (105), an axle retainer (108), and a first axle (109), wherein the axle retainer (108) is operatively connected to the bolt assembly (130), wherein the first axle (109) is disposed within the roller (105) and the axle retainer (108), wherein the roller assembly (128) is adjustable by the bolt assembly (130) via the hex head (114A);

a housing assembly (129) comprising a housing (102), wherein the housing assembly (129) is operatively connected to the roller assembly (128) via the bolt assembly (130), wherein the housing assembly (129) is further operatively connected to the roller assembly (128), wherein the housing (102) comprises a first plurality of surfaces (140Z) and a second plurality of surfaces (142Z), wherein the nut (113) is configured to substantially secure the bolt (114) to a first surface (140A) within the first plurality of surfaces (140Z), wherein the spring (111) is configured to be disposed between a base plate (101) and a second surface (142D) within the second plurality of surfaces (142Z), wherein the housing (102) further comprises a third plurality of surfaces (155Z), wherein the roller assembly (128) is disposed partially within the housing (102) with respect to the third plurality of surfaces (155Z); and the base plate (101) comprising a plurality of slots (127Z) configured to attach the base plate (101) to the switch point, wherein the base plate (101) further comprises a spring support (116), wherein the spring (111) is supported by the spring support (116) and is in contact with the housing assembly (129), the spring support (116) comprising an inner spring support (116B) and an outer spring support (116A), wherein the spring (111) is supported, at an inner diameter of the spring (111), via the inner spring support (116B), wherein the spring (111) is further supported, at an outer diameter of the spring (111), via the outer spring support (116A).

11. The kit of claim 10, wherein the bolt (114) comprises:

a first bolt segment (114B) being a first diameter and threaded;

a second bolt segment (114C) being a second diameter, the second diameter being smaller than the first diameter; and a third bolt segment (114D), the third bolt segment (114D) having a third diameter, the third diameter being smaller than the second diameter.

12. The kit of claim 10, wherein the roller assembly (128) further comprises:

a first bushing (119) in contact with the bolt assembly (130);

a retaining ring (120), the retaining ring (120) retaining the bolt assembly (130) at the axle retainer (108); and a plurality of needle bearings (118Z), the plurality of needle bearings (118Z) providing for rotation of the roller (105) about the first axle (109).

13. The kit of claim 12, wherein the axle retainer (108) comprises:

a first plurality of holes (122Z), the plurality of holes (122Z) supporting the first axle (109); and a first hole (124) accommodating the first bushing (119).

14. The kit of claim 10, wherein the housing assembly (129) comprises:

a plurality of bushings (117Z);

a second axle (107), the second axle (107) being disposed within the plurality of bushings (117Z);

a plurality of retaining rings (106Z), the plurality of retaining rings (106Z) being configured to retain the second axle (107); and a set screw (135), the set screw (135) being configured to be in contact with the second axle (107).

15. The kit of claim 14, the housing (102) further comprising:

a second plurality of holes (121Z), the second plurality of holes (121Z) being configured to accommodate the plurality of bushings (117Z); and a second hole (123), the second hole (123) being configured to accommodate the bolt assembly (130).

16. The kit of claim 10, the base plate (101) further comprising:

a protrusion (112) having a third hole (115), the third hole (115) being configured to accommodate the housing assembly (129), wherein the protrusion (112) further comprises a threaded hole (133), wherein the threaded hole (133) is oriented perpendicularly to the third hole (115) and is configured to receive a set screw (135).

17. The kit of claim 10, wherein the spring (111) is polymer, polyester, urethane, hardened steel, or a combination thereof.

18. The kit of claim 10, wherein the roller (105) is polymer, polyester, urethane, hardened steel, sealed glass having a nylon interior, or a combination thereof.

* * * * *